US007662462B2

(12) United States Patent
Noda et al.

(10) Patent No.: US 7,662,462 B2
(45) Date of Patent: Feb. 16, 2010

(54) NONWOVEN FABRIC

(75) Inventors: Yuki Noda, Kagawa (JP); Hideyuki Ishikawa, Kagawa (JP); Satoshi Mizutani, Kagawa (JP); Akihiro Kimura, Kagawa (JP)

(73) Assignee: Uni-Charm Corporation, Shikokuchuo-Shi, Ehime-Ken (JP)

( * ) Notice: Subject to any disclaimer, the term of this patent is extended or adjusted under 35 U.S.C. 154(b) by 0 days.

(21) Appl. No.: 11/756,229

(22) Filed: May 31, 2007

(65) Prior Publication Data

US 2008/0044628 A1 Feb. 21, 2008

(30) Foreign Application Priority Data

Jun. 23, 2006 (JP) ..... 2006-174505
Sep. 29, 2006 (JP) ..... 2006-270108

(51) Int. Cl.
*B32B 3/00* (2006.01)
*B32B 3/28* (2006.01)
*B32B 3/30* (2006.01)
*B32B 5/14* (2006.01)

(52) U.S. Cl. ..... 428/167; 428/156; 428/170; 428/172

(58) Field of Classification Search ..... 428/157, 428/167, 131, 137, 170–172, 218; 604/385.01, 604/378–380, 384; 442/327
See application file for complete search history.

(56) References Cited

U.S. PATENT DOCUMENTS 2,596,292 A * 5/1952 Sackner ..... 428/171
3,485,706 A 12/1969 Evans
4,016,317 A 4/1977 Kalwaites
4,016,319 A * 4/1977 Marshall ..... 428/113
4,835,042 A 5/1989 Dohzono et al.
5,607,414 A 3/1997 Richards et al.
5,618,610 A * 4/1997 Tomita et al. ..... 428/152
6,096,016 A * 8/2000 Tsuji et al. ..... 604/378
6,395,957 B1 5/2002 Chen et al.
6,451,718 B1 9/2002 Yamada et al.

(Continued)

FOREIGN PATENT DOCUMENTS

JP 02169718 A 6/1990

(Continued)

OTHER PUBLICATIONS

International Search Report of PCT/JP2007/060543 issued Jul. 10, 2007.

(Continued)

*Primary Examiner*—David R Sample
*Assistant Examiner*—Catherine Simone
(74) *Attorney, Agent, or Firm*—Lowe Hauptman Ham & Berner

(57) ABSTRACT

Nonwoven fabric has a plurality of groove portions continuously formed along a predetermined direction, and a plurality of raised ridge portions formed continuously along the groove portions, each adjacent to the groove portions. The basis weight is the least, and the content percentage of laterally-oriented fibers is high, and the content percentage of longitudinally-oriented fibers is low at the groove portions of the nonwoven fabric. Sides at the raised ridge portions are formed so that their basis weight is the greatest, and the content percentage of the fiber oriented toward a longitudinal direction is high.

5 Claims, 18 Drawing Sheets

U.S. PATENT DOCUMENTS

| | | | |
|---|---|---|---|
| 6,582,798 | B2 | 6/2003 | Thomas |
| 6,610,173 | B1 | 8/2003 | Lindsay et al. |
| 6,641,902 | B1 | 11/2003 | Kobayashi et al. |
| 6,855,424 | B1 | 2/2005 | Thomas et al. |
| 6,867,156 | B1 | 3/2005 | White et al. |
| 6,936,333 | B2 | 8/2005 | Shizuno et al. |
| 2003/0198784 | A1 | 10/2003 | Mizutani et al. |
| 2005/0177121 | A1 | 8/2005 | Mizutani et al. |
| 2008/0289157 | A1 | 11/2008 | Higashinaka et al. |

FOREIGN PATENT DOCUMENTS

| | | | |
|---|---|---|---|
| JP | 02-229255 | A | 9/1990 |
| JP | 08-060509 | A | 3/1996 |
| JP | 08-216310 | A | 8/1996 |
| JP | 11-342154 | A | 12/1999 |
| JP | 2002-030557 | A | 1/2002 |
| JP | 2002-136547 | A | 5/2002 |
| JP | 2002-249965 | A | 9/2002 |
| JP | 2003-024372 | A | 1/2003 |
| JP | 3587831 | B2 | 8/2004 |
| WO | 2005122817 | A1 | 12/2005 |

OTHER PUBLICATIONS

International Search Report of PCT/JP2007/061601 issued Aug. 7, 2007.
International Search Report of PCT/JP2007/061455 issued Jul. 31, 2007.
International Search Report of Application No. PCT/JP2007/061444 mailed Aug. 7, 2007.
Office Action issued to U.S. Appl. No. 11/755,376 mailed Jun. 30, 2009.
Office Action issued Aug. 4, 2009, from U.S. Appl. No. 11/748,712, filed May 15, 2007.
Office Action issued Oct. 6, 2009, from U.S. Appl. No. 11/762,421, filed Jun. 13, 2007.
USPTO Office Action mailed Nov. 25, 2009.

* cited by examiner

NONWOVEN FABRIC

This application is based on and claims the benefit of priority from Japanese Patent Application No. 2006-174505, filed on 23 Jun. 2006 and Japanese Patent Application No. 2006-270108, filed on 29 Sep. 2006, the content of which are incorporated herein by reference.

BACKGROUND OF THE INVENTION

1. Field of the Invention

The present invention relates to nonwoven fabric.

2. Related Art

Conventionally, nonwoven fabrics are used in a wide range of fields from hygienic products, such as baby diapers or feminine care articles (sanitary napkins) to cleaning products, such as wipers, or medical products, such as masks. Such nonwoven fabric is used in many different fields, but when actually used in products of each of those fields, it is necessary that the nonwoven fabric is manufactured with the properties and structures appropriate for their intended use.

Nonwoven fabric is manufactured by forming a fibrous layer (fiber web) using a dry method or a wet method, and then bonding the fibers that compose the fibrous layer together using a chemical bonding method or a thermal bonding method. There is a method of bonding the fibers, that compose the fibrous layer, in which a plurality of needles are repeatedly inserted into the fibrous layer, and there is a method wherein physical force, such as a blowing a race, is externally applied to the fibrous layer.

However, these methods only entangle the fibers and do not adjust the orientation or the arrangement of the fibers in the fibrous layer, or the shape of the fibrous layer. In other words, the fiber beds manufactured using these methods are simply sheet-shaped nonwoven fabric.

Also, if a predetermined liquid of excreta is applied to a nonwoven fiber used as a surface sheet of an absorbent material, for example, nonwoven fabric having an uneven surface are preferred to maintain or improve the feeling against the skin. For example, Japanese Patent No. 3587831 (hereinafter referred to as Patent Document 1) discloses nonwoven fabric formed with an uneven surface by heat contraction of a predetermined layer by laminating and thermally bonding a plurality of fibrous layers composed of fibers having different heat contraction characteristics, and a manufacturing method of the same.

These nonwoven fabrics are integrated when forming the uneven layer by laminating a plurality of fibrous layers and thermally bonding each fibrous layer. The result is high-density fibers, with low liquid-penetrability in many of the thermally-bonded areas. In addition, the areas can also sometimes be turned into a film. If the thermally bonded area turns into a film, it is even more difficult for the liquid to penetrate downward quickly.

Here, a second fibrous layer composed of non-heat-shrinkable fibers is laminated to a single side or both sides of a first fibrous layer including heat-shrunk heat-shrinkable fibers, the first fibrous layer and the second fibrous layer being integrated by a plurality of thermal bonding portions for the nonwoven fabric disclosed in Patent Document 1. In the thermal bonding portions, a plurality of convex portions is formed with the second fibrous layer projected by the heat shrinking of the first fibrous layer.

In other words, as shown by the nonwoven fabric and nonwoven fabric manufacturing method as described in Patent Document 1, conventionally, to form the fiber web into concave and convex portions, a plurality of fibrous layers having different properties is necessary. Therefore, the manufacturing processes are complicated. Also, if the first fibrous layer and the second fibrous layer are pulled apart during the heat shrinking process, the convex portions cannot be formed at the second fibrous layer, so it is necessary to securely bond the plurality of thermal-bonding portions of the first and the second fibrous layers. Therefore, fiber density at the thermally bonded portions is higher, and in some cases, the fibers are turned to film. This causes the problem of a thermally bonded area not being able to quickly pass a predetermined liquid of excreta, and the like. The present invention solves the aforementioned problems.

SUMMARY OF THE INVENTION

It is an object of the present invention is to provide nonwoven fabric that easily pass liquids, such as excreta, and have concave and convex portions.

The inventors recognized that it is possible to manufacture nonwoven fabric that easily pass liquids, and have concave and convex portions by moving fibers composing a fiber web, supported from a bottom surface side by a predetermined air-permeable support member, while blowing a gas from a top surface side, and completed the invention.

According to a first embodiment of the present invention nonwoven fabric bonded by overlapping fibers in a three-dimensional structure, having: a plurality of groove portions formed to extend in a first direction of a first surface side; and a plurality of raised ridge portions formed to extend in the first direction, each adjacent to the plurality of groove portions on the first surface side.

In a second embodiment of the nonwoven fabric, as described in the first embodiment of the present invention, a height in a thickness direction of each of the plurality of groove portions is no greater than 90% of a height in a thickness direction of each of the plurality of raised ridge portions.

In a third embodiment of the nonwoven fabric, as described in either one of the first or second embodiments of the present invention, a predetermined raised ridge portion of the plurality of raised ridge portions has a different height in the thickness direction to an adjacent raised ridge portion.

In a fourth embodiment of the nonwoven fabric, as described in any one of the first to third embodiments of the present invention, a peak of each of the plurality of raised ridge portions is substantially flat.

In a fifth embodiment of the nonwoven fabric, as described in any one of the first to fourth embodiments of the present invention, a plurality of regions, at a second surface side that is a surface of an opposite side to the first surface side, project to an opposite side to a projecting direction at the raised ridge portions.

In a sixth embodiment of the nonwoven fabric, as described in any one of the first to fifth embodiments of the present invention, the nonwoven fabric having rolling wave-forms in the first direction.

In a seventh embodiment of the nonwoven fabric, as described in any one of the first to fourth embodiments of the present invention, a second surface that is a surface of an opposite side to the first surface side on the nonwoven fabric is substantially flat.

In an eighth embodiment of the nonwoven fabric, as described in any one of the first to seventh embodiments of the present invention, the plurality of groove portions are provided a plurality indentations formed at predetermined spaces; and a plurality of projections that are regions excluding the plurality of indentations.

In a ninth embodiment of the nonwoven fabric, as described in the eighth embodiment of the present invention, a high in the thickness direction of each of the plurality of projections is less than a height in the thickness direction at each of the plurality of raised ridge portions.

In a tenth embodiment of the nonwoven fabric, as described in either the eighth or ninth embodiment of the present invention, a high in the thickness direction of each of the plurality of indentations is a maximum of 90% of a height in the thickness direction at each of the plurality of projections.

In an eleventh embodiment of the nonwoven fabric, as described in any of the eighth to tenth embodiments of the present invention, the first surface side and the second surface side at each of the plurality of projections are substantially flat.

In a twelfth embodiment of the nonwoven fabric, as described in any one of the eighth to eleventh embodiments of the present invention, a length in the first direction at each of the plurality of projections is between 0.1 mm to 30 mm.

In a thirteenth embodiment of the nonwoven fabric, as described in any one of the eighth to twelfth embodiments of the present invention, a length in the first direction at each of the plurality of indentations is between 0.1 mm to 30 mm.

In a fourteenth embodiment of the nonwoven fabric, as described in any one of the eighth to thirteenth embodiments of the present invention, a basis weight at each of the plurality of projections is less than a basis weight at each of the plurality of raised ridge portions, and a basis weight at each of the plurality of indentations is less than a basis weight at each of the plurality of projections.

In a fifteenth embodiment of the nonwoven fabric, as described in any one of the eighth to fourteenth embodiments of the present invention, the basis weight at each of the plurality of projections is between 5 to 200 $g/m^2$; and the weight at each of the plurality of indentations is between 0 to 100 $g/m^2$.

In a sixteenth embodiment of the nonwoven fabric, as described in any one of the first to fifteenth embodiments of the present invention, the basis weight at each of the plurality of groove portions is less than the basis weight at each of the plurality of raised ridge portions.

In a seventeenth embodiment of the nonwoven fabric, as described in any one of the first to sixteenth embodiments of the present invention, a fiber density at each of the plurality of groove portions is less than a fiber density at each of the plurality of raised ridge portions.

In an eighteenth embodiment of the nonwoven fabric, as described in any one of the first to seventeenth embodiments of the present invention, a content percentage of fibers oriented in a second direction that is perpendicular to the first direction at the plurality of groove portions is greater than a content percentage of the fibers oriented in the first direction.

In a nineteenth embodiment of the nonwoven fabric, as described in any one of the first to eighteenth embodiments of the present invention, a content percentage of fibers oriented in the first direction for each of the plurality of side portions at the plurality of raised ridge portions is greater than a content percentage of the fibers oriented in the second direction.

In a twentieth embodiment of the nonwoven fabric, as described in any one of the first to nineteenth embodiments of the present invention, a fiber composing the nonwoven fabric include water repellent fibers.

The present invention provides nonwoven fabric formed with at least a groove portion and convex shapes, and allows the easy penetration of a predetermined liquid, such excreta.

DETAILED DESCRIPTION OF THE INVENTION

Preferred embodiments of the present invention will now be explained with reference to the drawings.

Figure 1:
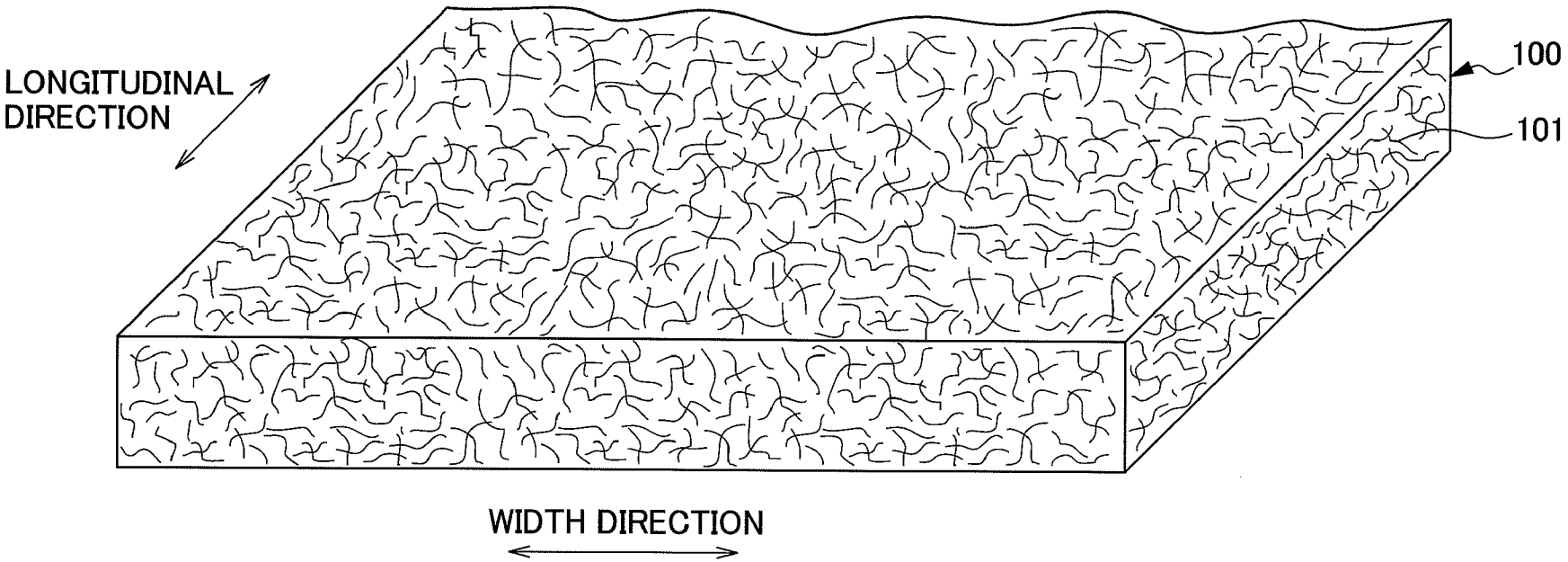
FIG. 1 shows a perspective view of a fiber web.
Figure 2A:
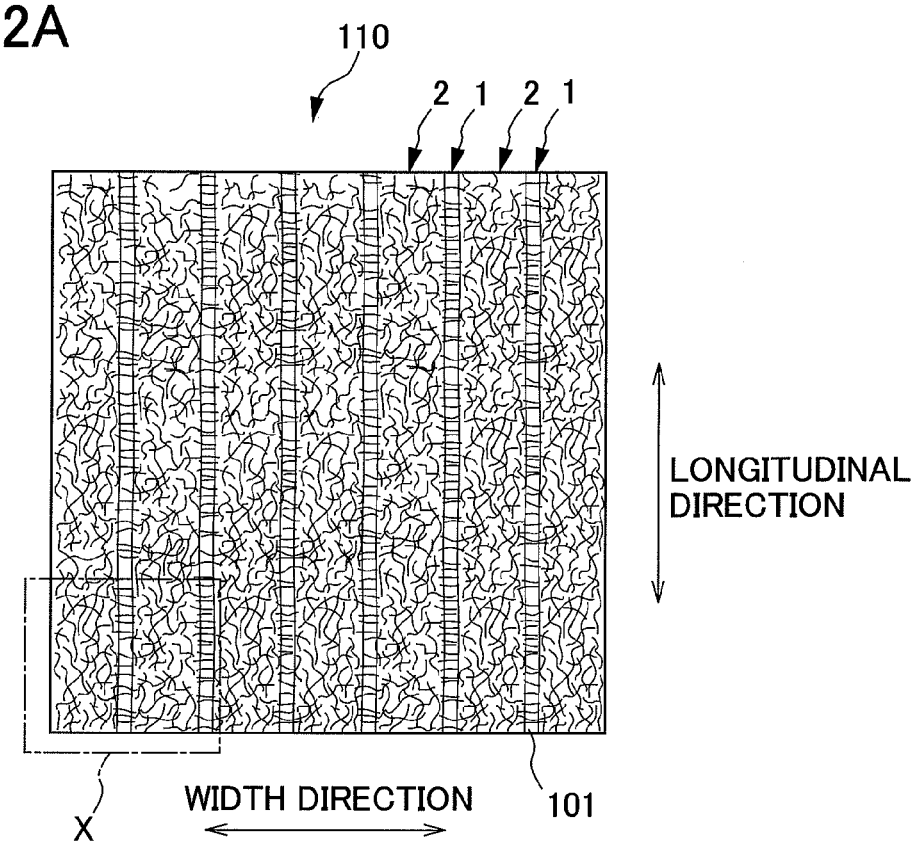
FIG. 2A shows a plan view and a bottom view of nonwoven fabric according to a first embodiment.
Figure 2B:
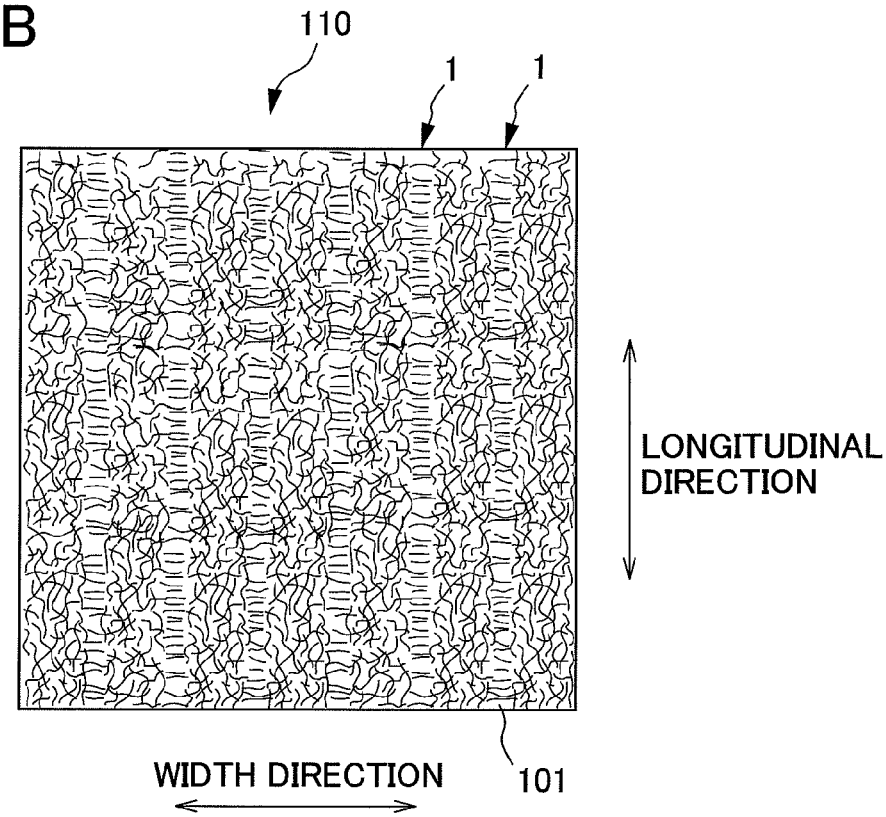
FIG. 2B shows a plan view and a bottom view of nonwoven fabric according to a first embodiment.
Figure 3:
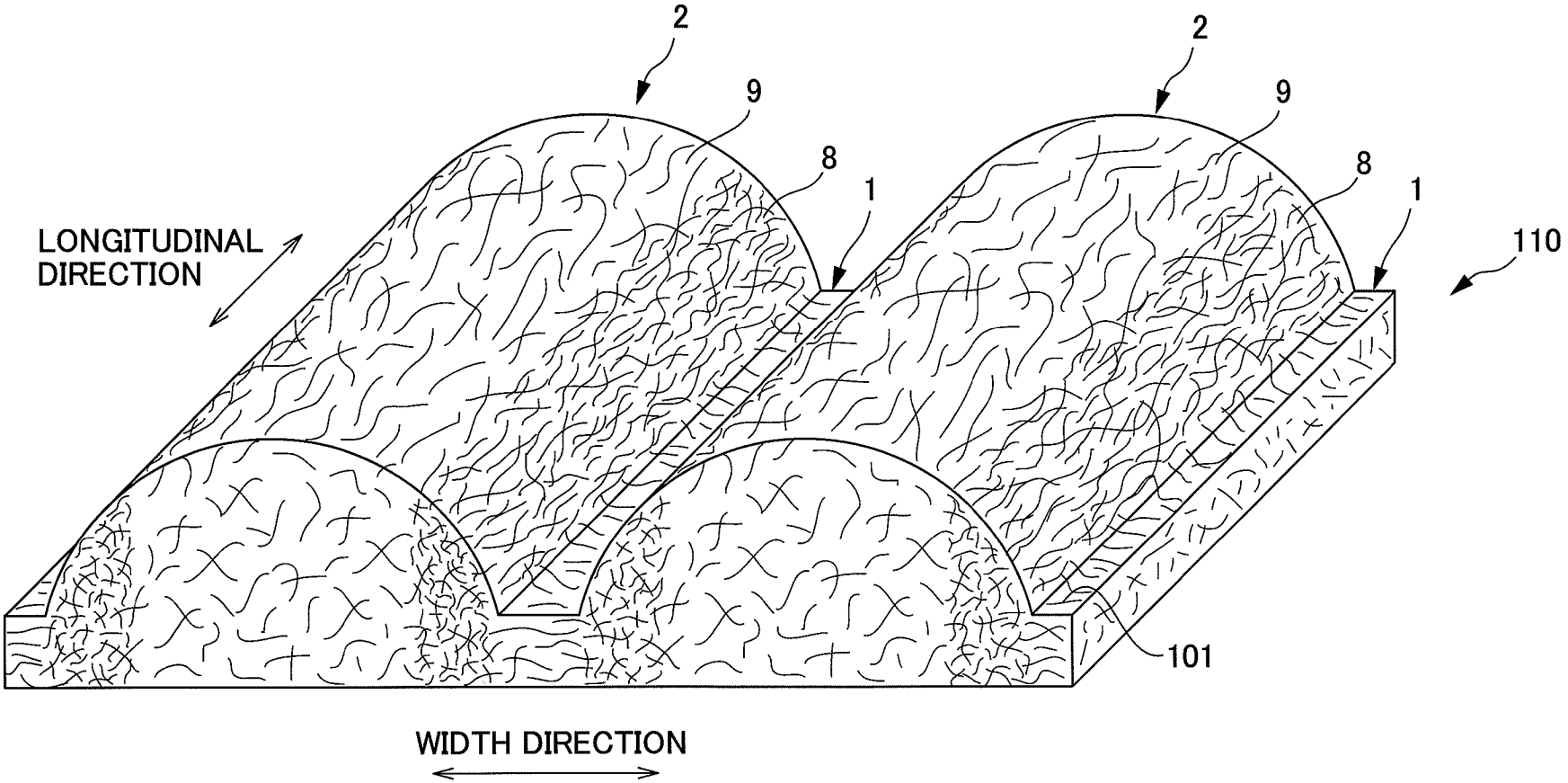
FIG. 3 shows an expanded perspective view of an area X as defined in FIGS. 2A and 2B.
Figure 4A:
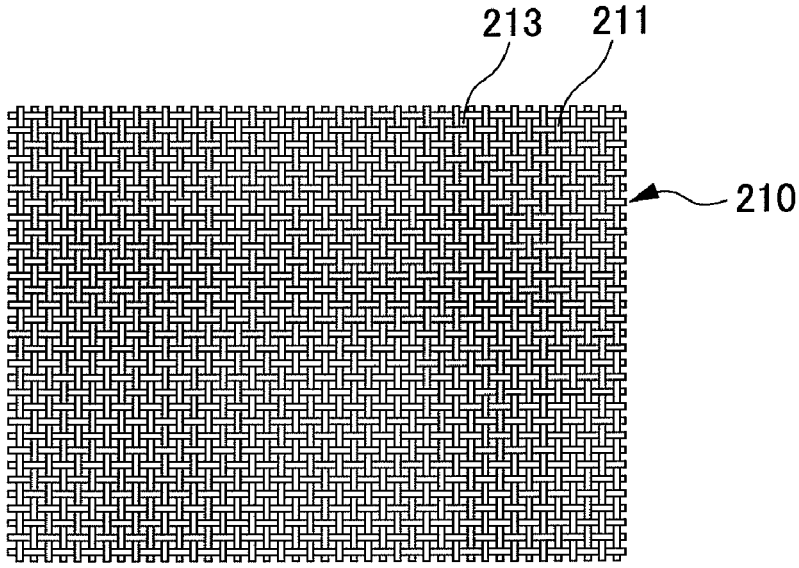
FIG. 4A shows a plan view and a perspective view of a mesh supporting member.
Figure 4B:
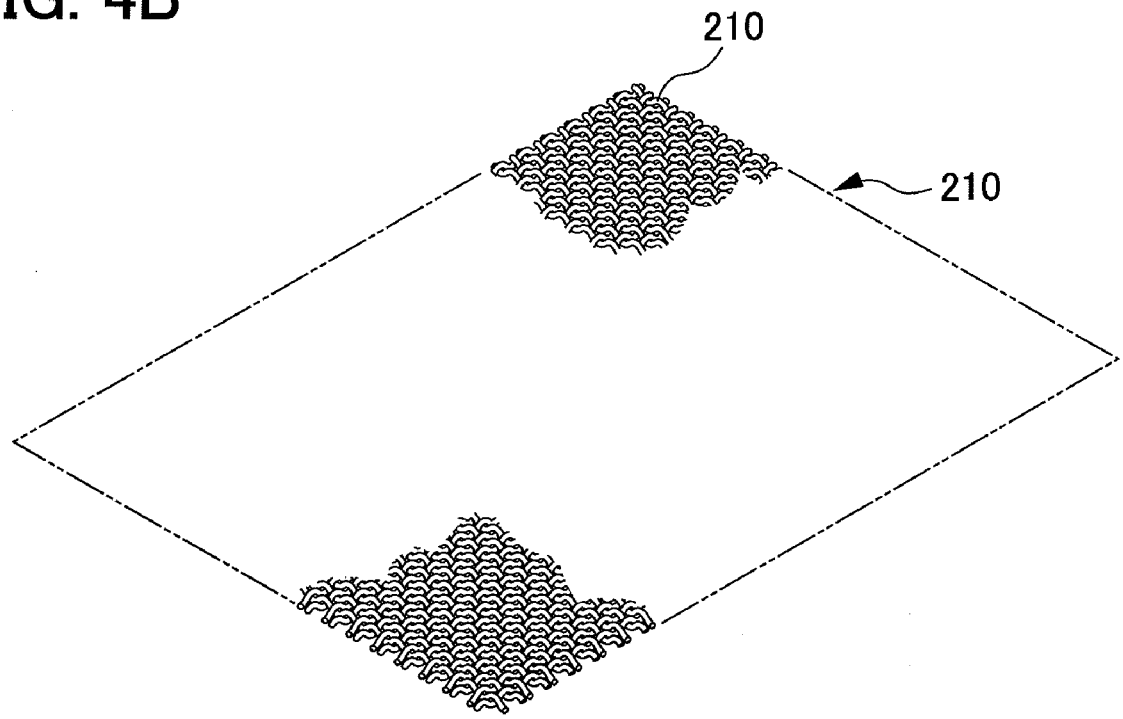
FIG. 4B shows a plan view and a perspective view of a mesh supporting member.
Figure 5:
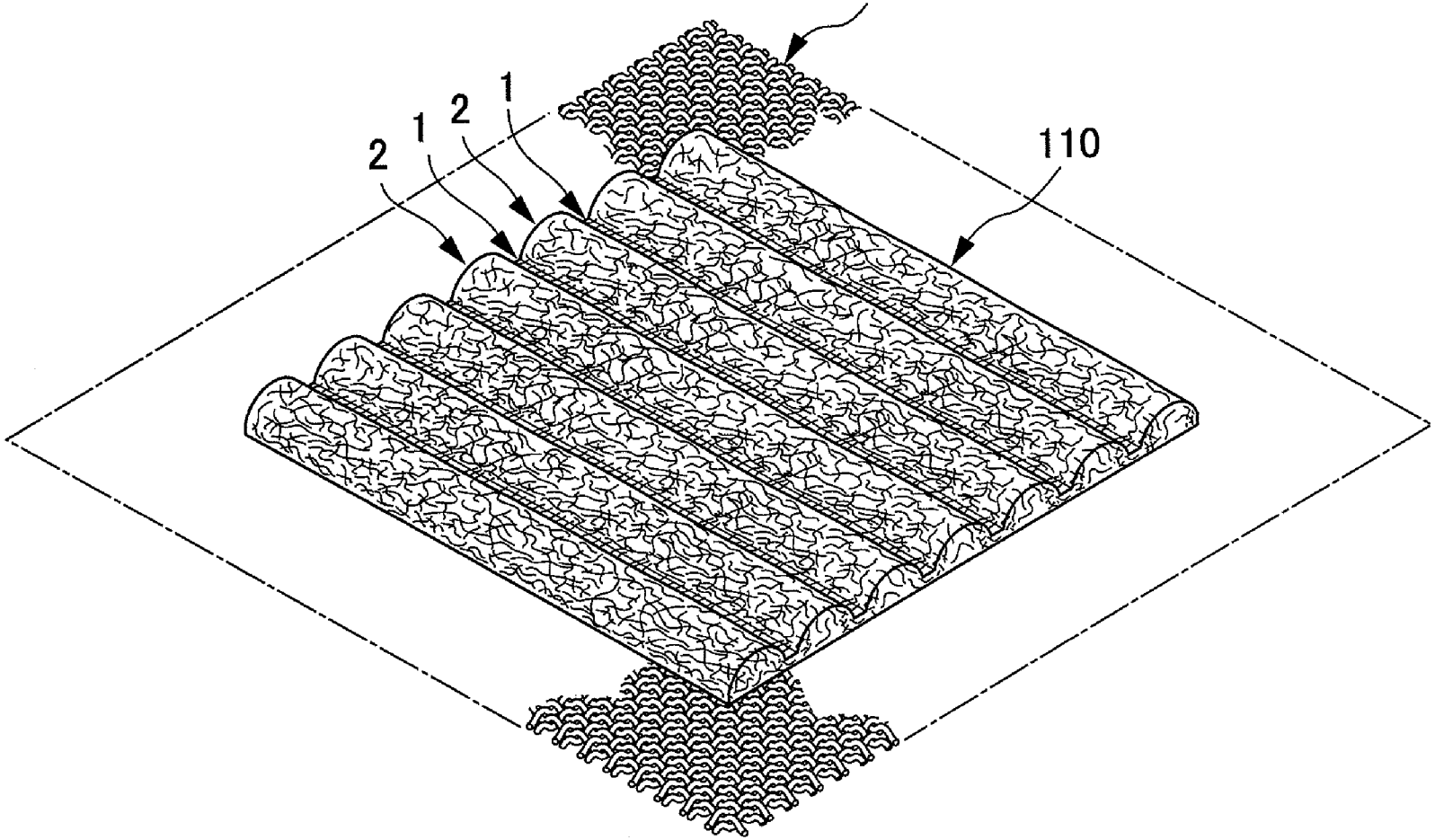
FIG. 5 shows the nonwoven fabric, of the first embodiment of FIGS. 2A and 2B, blown from above by a gas, the fiber web supported by the mesh support member of FIGS. 4A and 4B on a bottom side.
Figure 6:
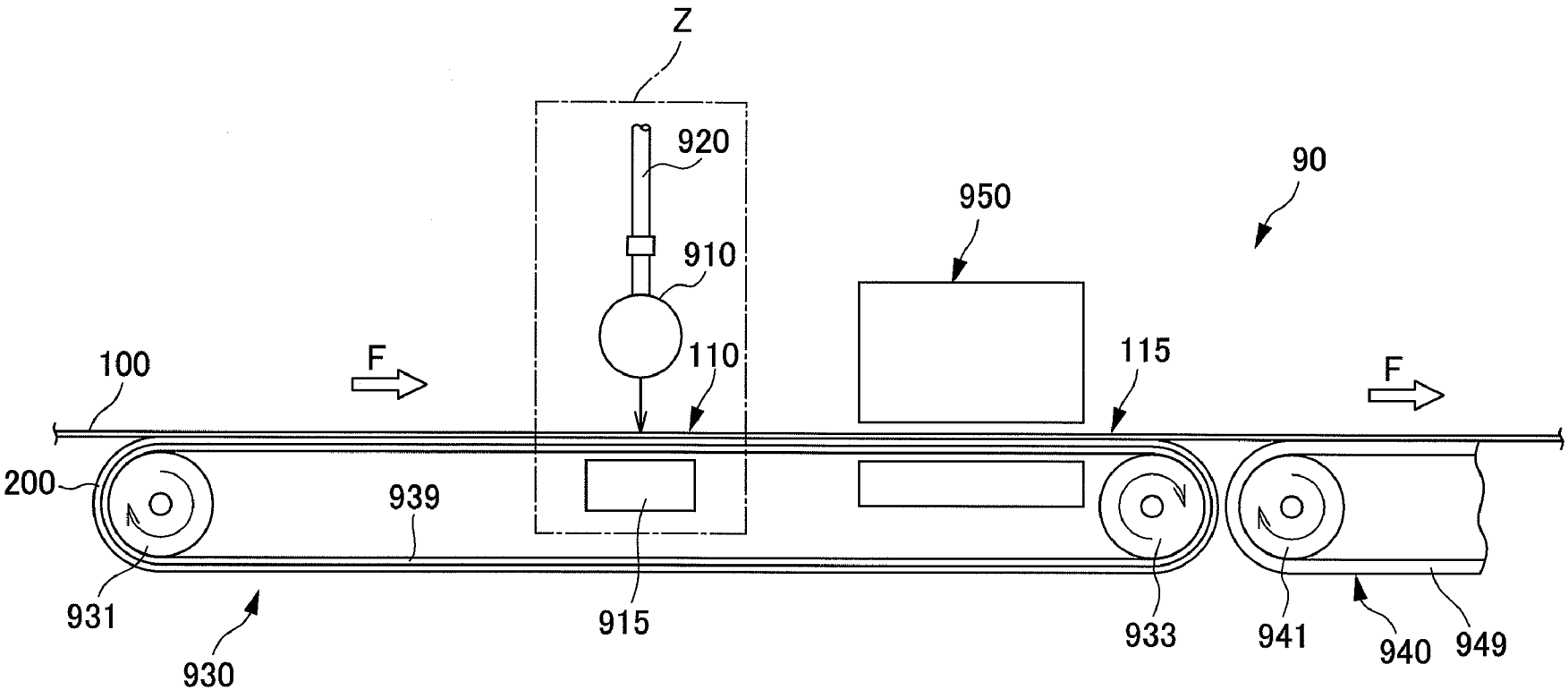
FIG. 6 shows a side view to explain the nonwoven fabric manufacturing apparatus of the first embodiment.
Figure 7:
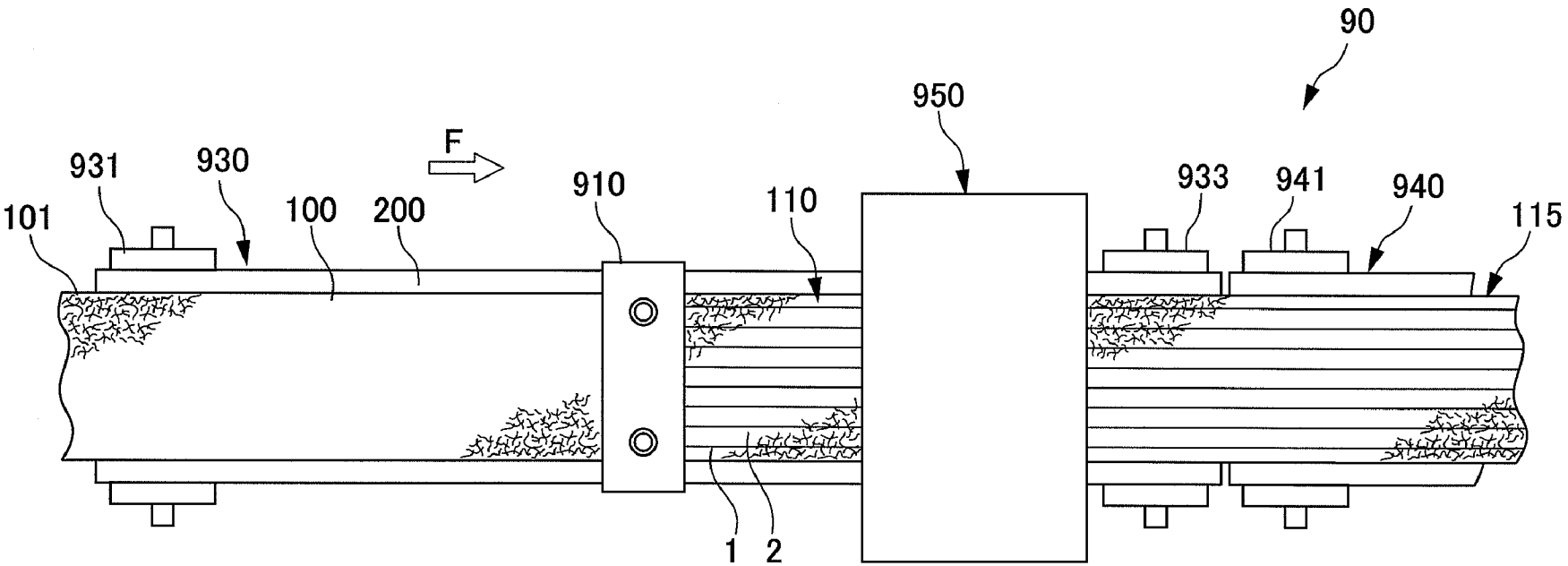
FIG. 7 is a plan view to explain the nonwoven fabric manufacturing apparatus as described in FIG. 6.
Figure 8:
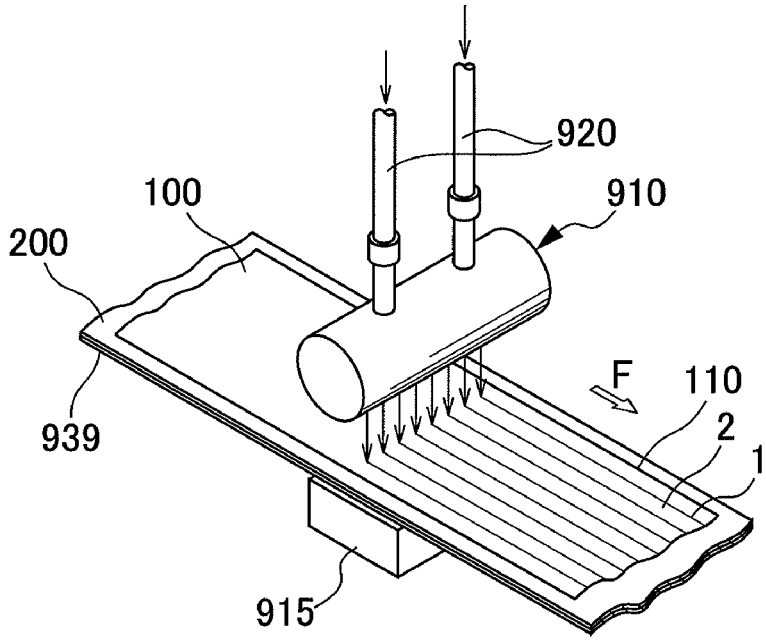
FIG. 8 shows an expanded perspective view of an area Z as defined FIG. 6.
Figure 9:
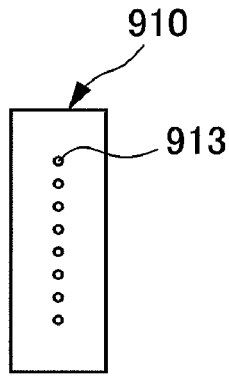
FIG. 9 shows a bottom view of the blowing unit as described in FIG. 8.
Figure 10:
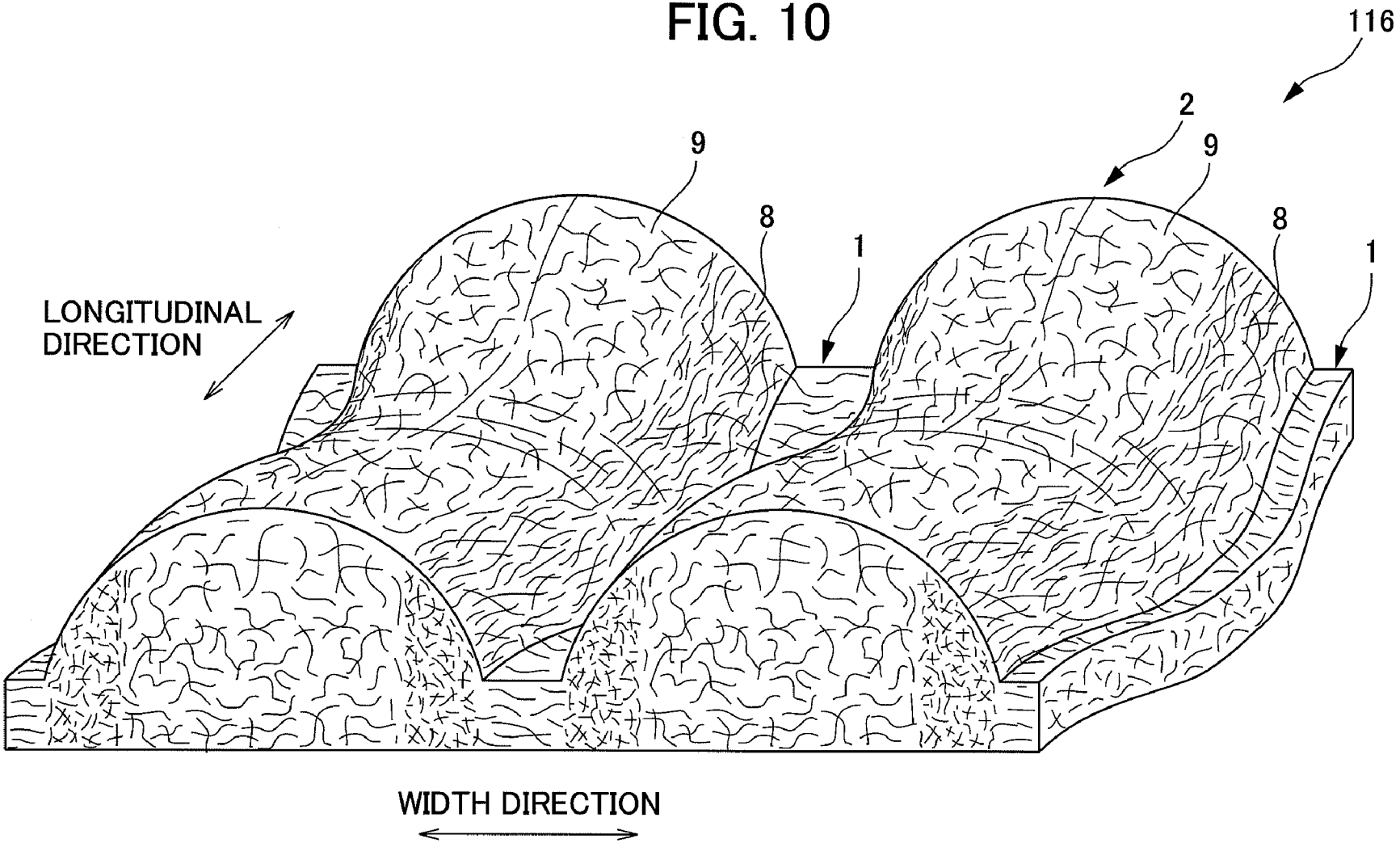
FIG. 10 shows an enlarged perspective view of the nonwoven fabric according to a second embodiment.
Figure 11:
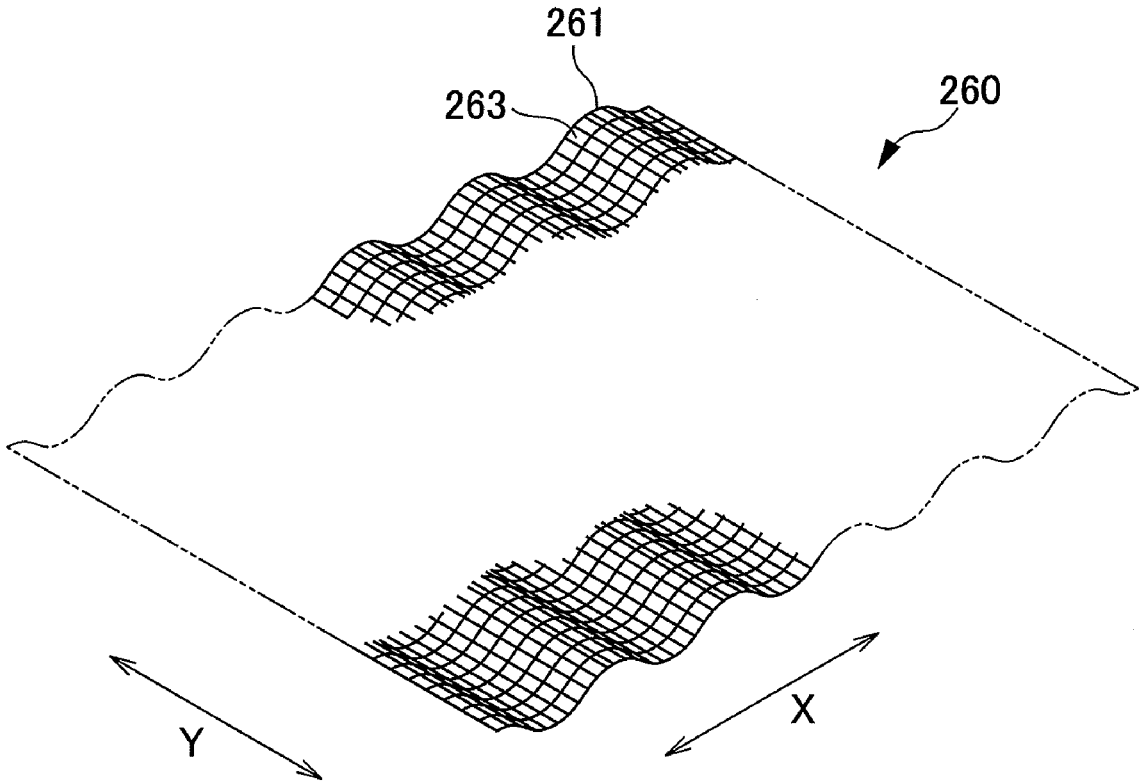
FIG. 11 shows an enlarged perspective view of the mesh supporting member in the second embodiment.
Figure 12:
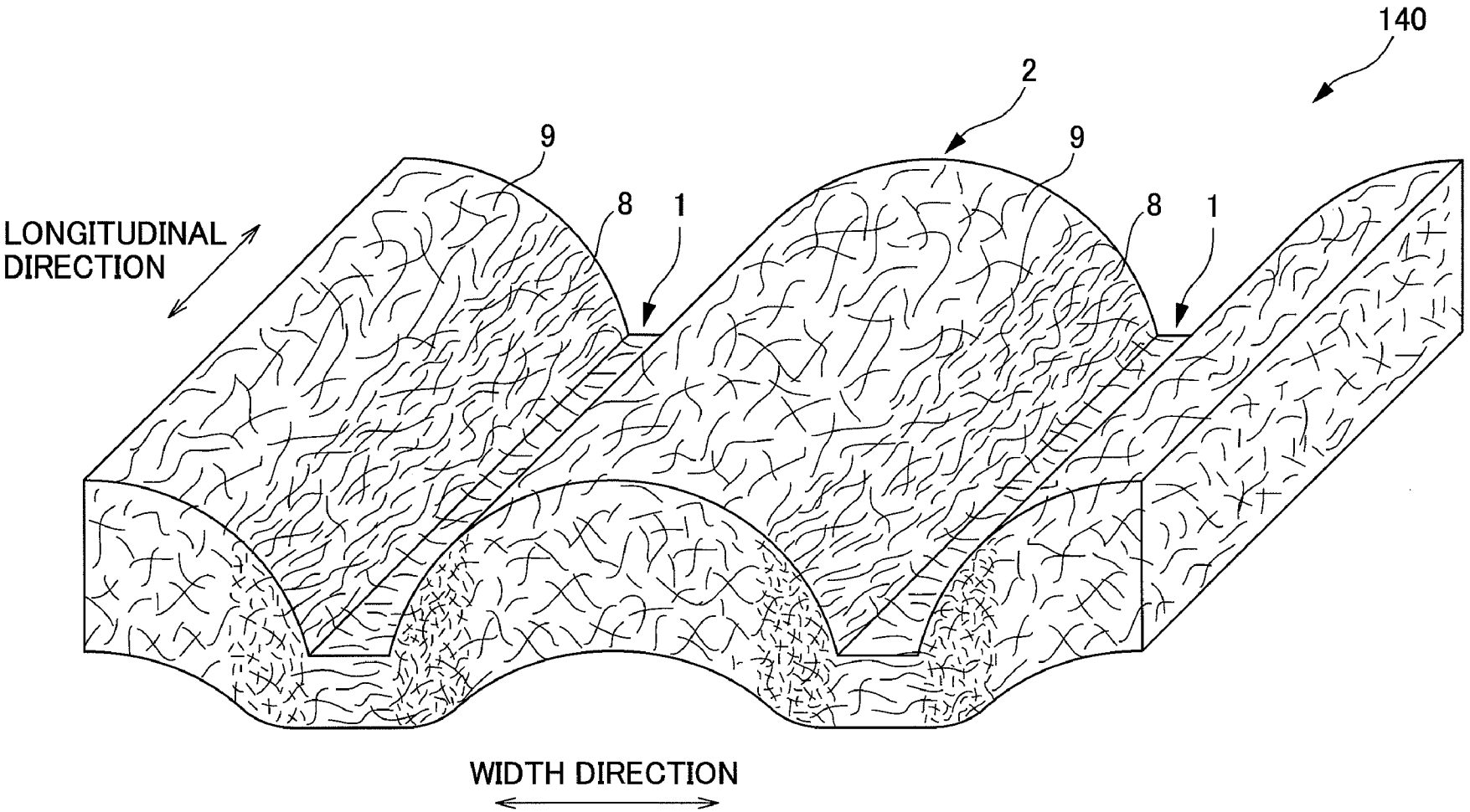
FIG. 12 shows an enlarged perspective view of the nonwoven fabric according to a third embodiment.
Figure 13:
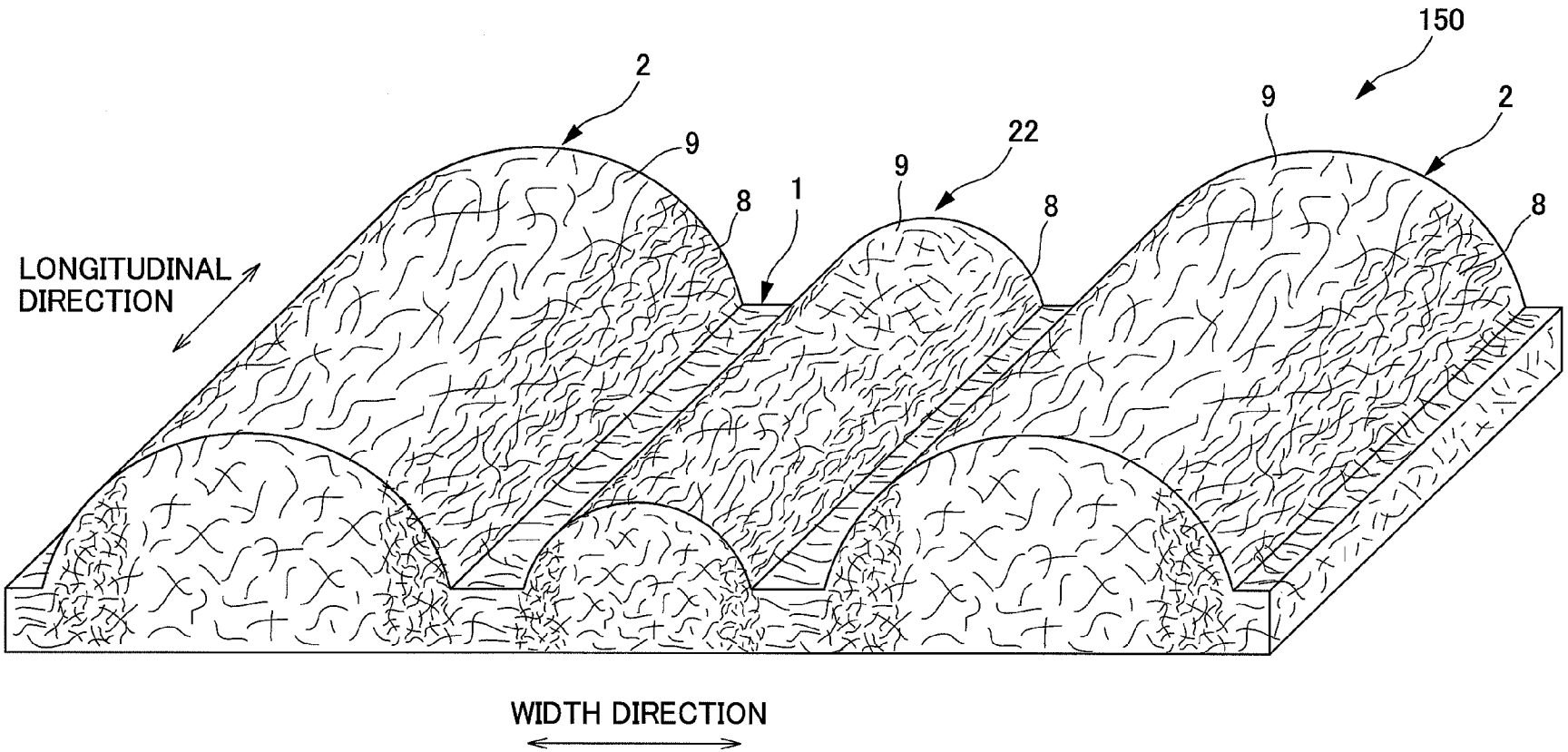
FIG. 13 shows an enlarged perspective view of the nonwoven fabric according to a fourth embodiment.
Figure 14:
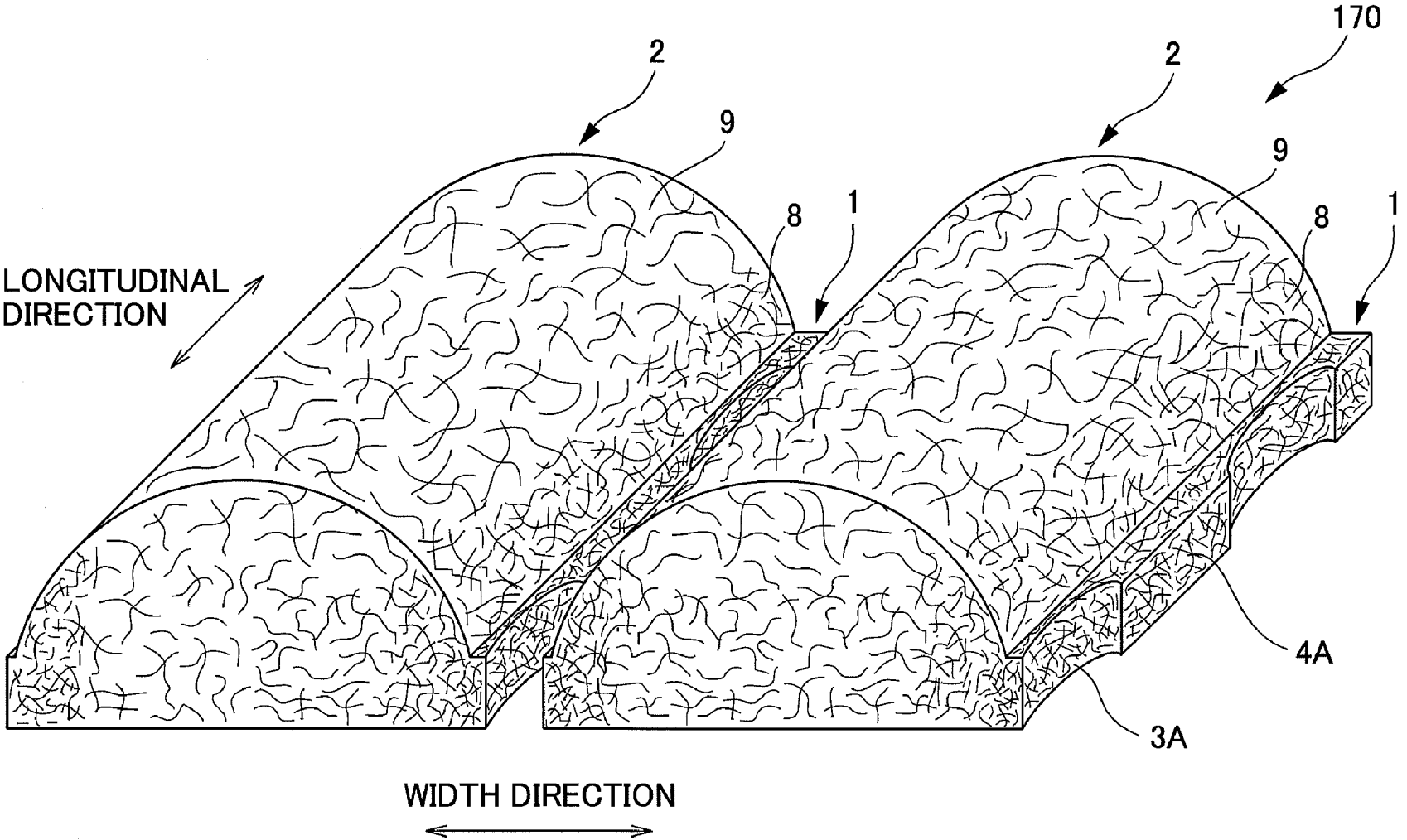
FIG. 14 shows an enlarged perspective view of the nonwoven fabric according to a fifth embodiment.
Figure 15:
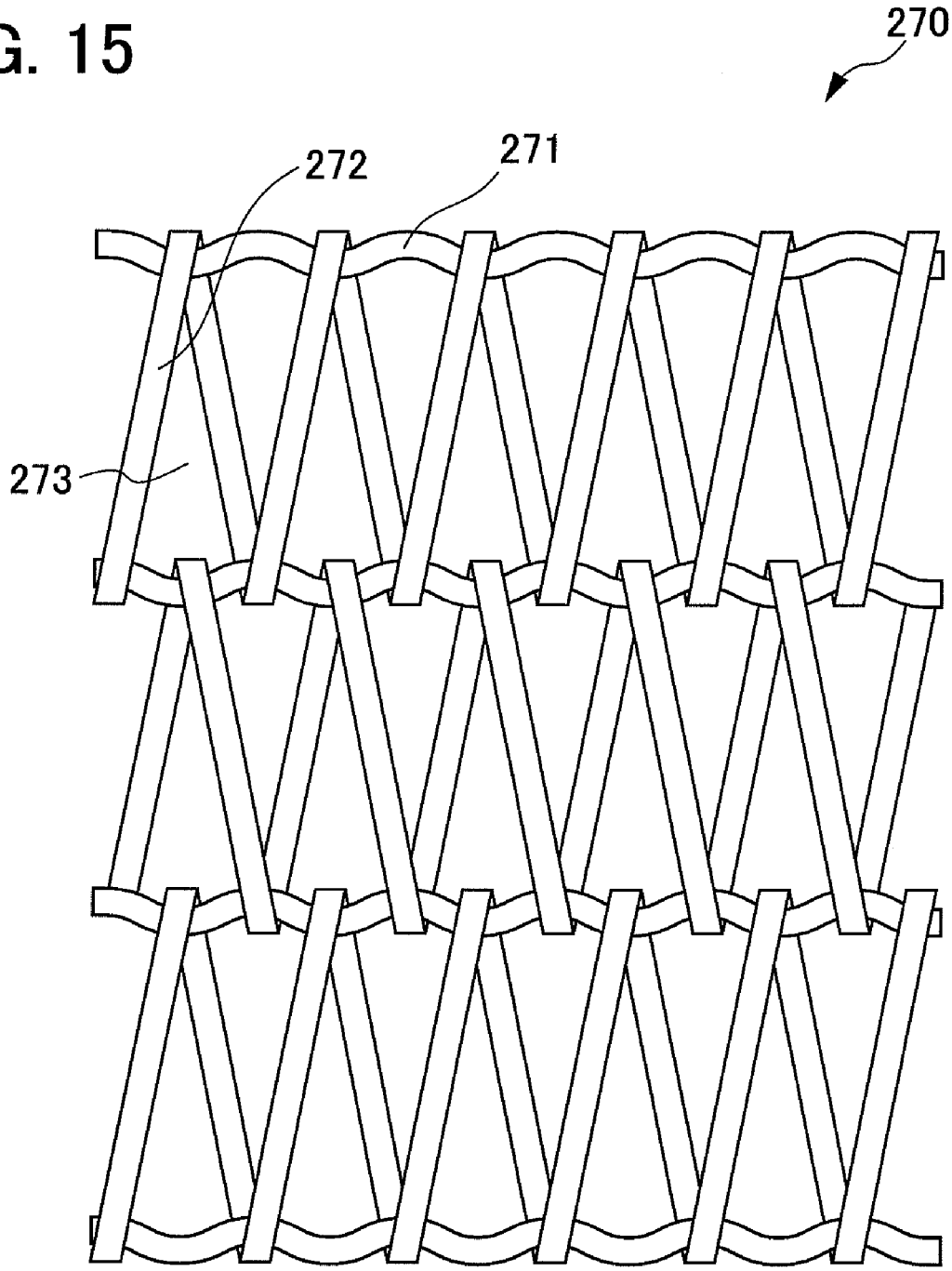
FIG. 15 shows an enlarged perspective view of the support member that manufactures the nonwoven fabric of FIG. 14.
Figure 16:
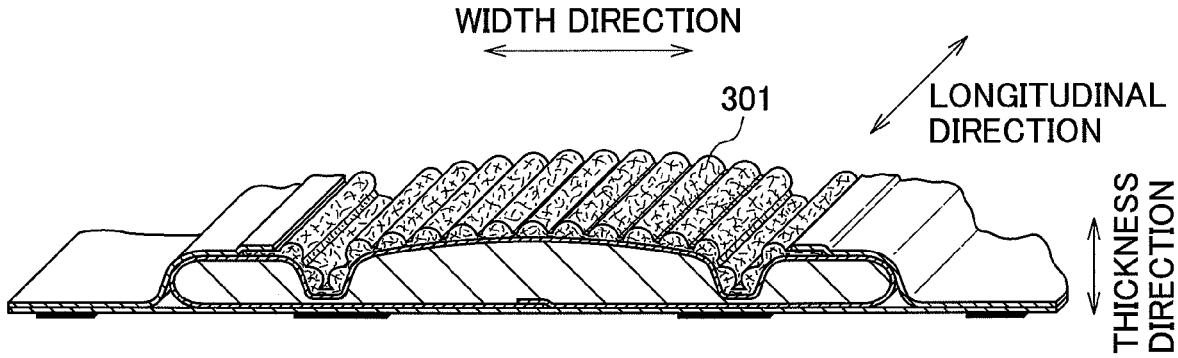
FIG. 16 is a perspective, sectional view when the nonwoven fabric of the present invention is used in a surface sheet of a sanitary napkin.
Figure 17:
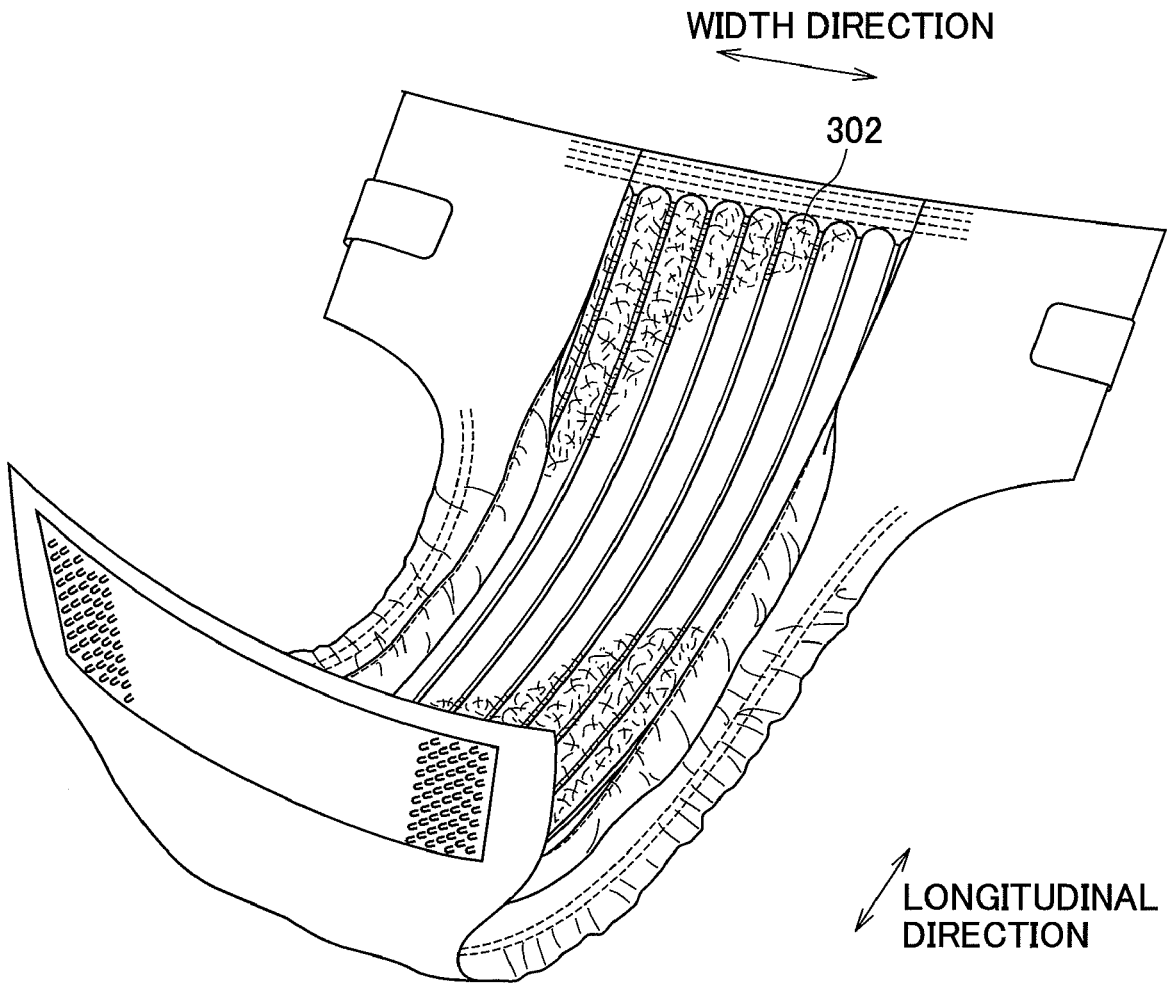
FIG. 17 is a perspective view of the nonwoven fabric of the present invention when used in a surface sheet of a diaper.
Figure 18:
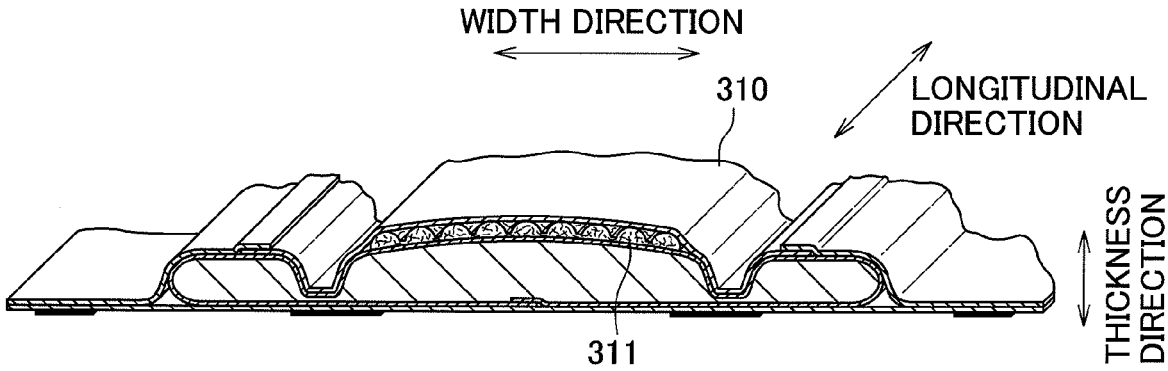
FIG. 18 is a perspective, sectional view when the nonwoven fabric of the present invention are used in a middle sheet of an absorbent article.
Figure 19:
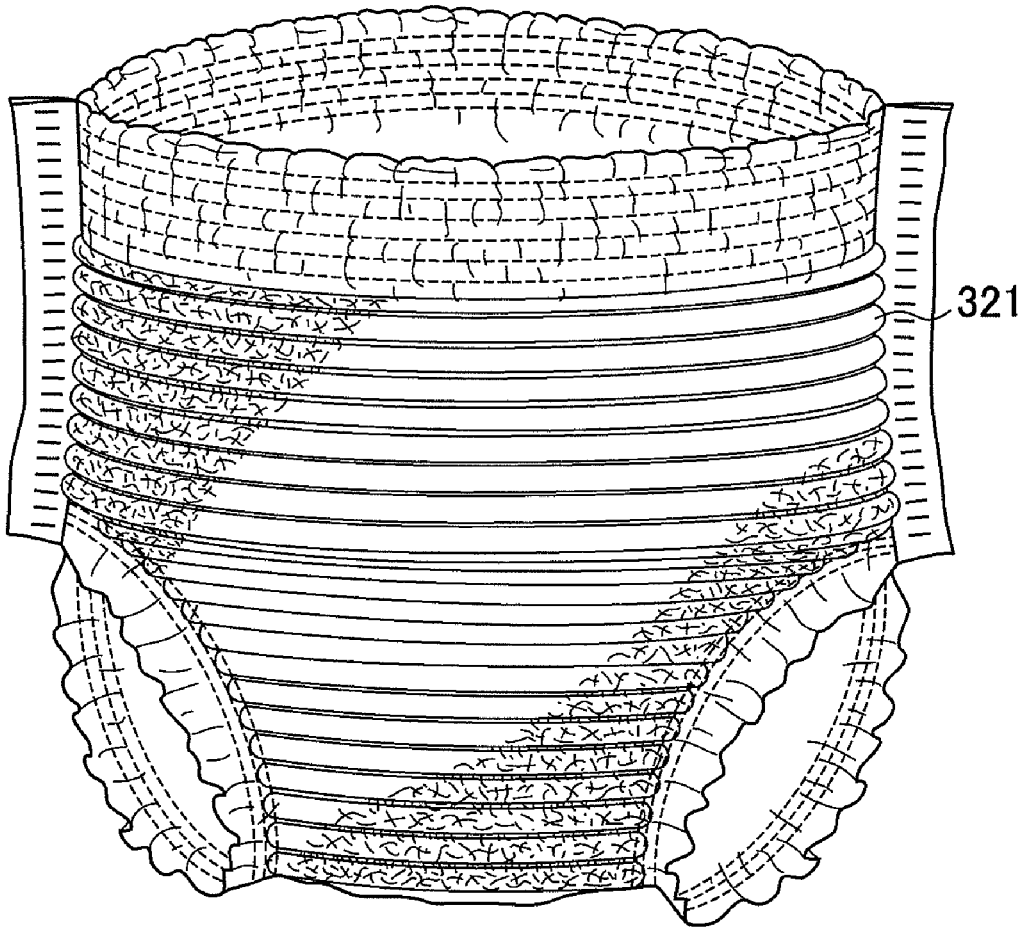
FIG. 19 is a perspective view of the nonwoven fabric of the present invention when used as an external wrapping material of an absorbent article.

FIG. 1 shows a perspective view of a fiber web. FIG. 2A shows a plan view and a bottom view of nonwoven fabric according to a first embodiment. FIG. 2B shows a plan view and a bottom view of nonwoven fabric according to a first embodiment. FIG. 3 shows an expanded perspective view of an area X as defined in FIGS. 2A and 2B. FIG. 4A shows a plan view and a perspective view of a mesh supporting member. FIG. 4B shows a plan view and a perspective view of a mesh supporting member. FIG. 5 shows the nonwoven fabric of the first embodiment of FIGS. 2A and 2B blown from above by a gas, the fiber web supported by the mesh support member of FIGS. 4A and 4B on a bottom side. FIG. 6 shows a side view to explain the nonwoven fabric manufacturing apparatus of the first embodiment. FIG. 7 shows a plan view to explain the nonwoven fabric manufacturing apparatus of FIG. 6. FIG. 8 shows an expanded perspective view of an area Z as defined in FIG. 6. FIG. 9 is a bottom view of the blowing unit of FIG. 8. FIG. 10 shows an enlarged perspective view of the nonwoven fabric in a second embodiment. FIG. 11 shows an enlarged perspective view of the mesh supporting members in the second embodiment. FIG. 12 shows an enlarged perspective view of the nonwoven fabric in a third embodiment. FIG. 13 shows an enlarged perspective view of the nonwoven fabric in a fourth embodiment. FIG. 14 shows an enlarged perspective view of the nonwoven fabric in a fifth embodiment. FIG. 15 shows an enlarged perspective view of the support member that manufactures the nonwoven fabric of FIG. 14. FIG. 16 shows a perspective, sectional view when the nonwoven fabric of the present invention is used in a surface sheet of a sanitary napkin. FIG. 17 shows a perspective view when the nonwoven fabric of the present invention are used in a surface sheet of a diaper. FIG. 18 shows a perspective, sectional view when the nonwoven fabric of the present invention is used in a middle sheet of an absorbent article. FIG. 19 shows a perspective view when the nonwoven fabric of the present invention are used as an external wrapping material of an absorbent article.

1. FIRST EMBODIMENT OF THE NONWOVEN FABRIC

FIGS. 2A to 5 explain the first embodiment of the nonwoven fabric of the present invention.

1-1. Shapes

As shown in FIGS. 2A, B and FIG. 3, a plurality of groove portions 1 is formed in parallel at substantially equidistant spacing along a first direction (hereinafter referred to as a longitudinal direction) on a first side of the nonwoven fabric 110 according to this embodiment. In this embodiment, the plurality of groove portions 1 is formed in parallel at equidistance spacing, but this is not meant to be a limitation. The spacing between adjacent groove portions 1 can be different. It is also acceptable that the spacing of the groove portions 1 is not parallel, but varied.

Furthermore, raised ridge portions 2 are formed between two adjacent groove portions 1 and 1. A plurality of raised ridge portions 2 and 2 are formed in parallel at equidistant spacing, in the same way as the groove portions 1. The heights (the thickness direction) of the raised ridge portions 2 of the nonwoven fabric 110 of this embodiment are substantially uniform, but it is acceptable that the heights of mutually adjacent raised ridge portions 2 to be different. For example, as a method for forming different heights of the raised ridge portions 2, it is possible to adjust the heights of the raised ridge portions 2 by adjusting the spacing of the blowing nozzles 913 that emits a fluid composed mainly of gas. By narrowing the spacing of adjacent blowing nozzles 913, it is possible to lower the heights of the raised ridge portions 2, and conversely, by widening the spacing of adjacent blowing nozzles 913, it is possible to raise the heights of the raised ridge portions 2. Also, by setting the spacing of the adjacent blowing nozzles 913 so that there are alternating narrow spaces and wide spaces, it is possible to alternately form raised ridge portions 2 of different heights. Also, in this way, if the heights of the raised ridge portions 2 are partially varied, the surface area that touches the skin is reduced so there is a merit that the load on the skin is reduced.

The heights of the raised ridge portions 2 that are the distances in the thickness direction in the nonwoven fabric 110 of this embodiment are between 0.3 and 15 mm; preferably between 0.5 and 5 mm. The lengths in a second direction (hereinafter referred to as the lateral direction or the cross direction) that is perpendicular to a first direction per raised ridge portion 2 is between 0.5 to 30 mm; preferably 1.0 to 10 mm. Also, the distance between peaks of adjacent raised ridge portions 2 and 2 is 0.5 to 30 mm; preferably between 3 to 10 mm.

Also, the heights (the distance in the thickness direction) of the nonwoven fabric 110 of an area formed of groove portions 1 are between 0 to 90% with regard to the heights of raised ridge portions 2, preferably between 1 to 50%; more preferably between 5 to 20%. The width of the groove portions 1 is between 0.1 to 30 mm; preferably from 0.5 to 10 mm. Also, the distances (pitches) between adjacent groove portions 1 sandwiching the raised ridge portions 2 are between 0.5 to 20 mm; preferably from 3 to 10 mm.

By configuring the groove portions 1 and raised ridge portions 2 as described above, it is difficult for a mass of a predetermined liquid to spread widely across the surface, if the nonwoven fabric 110 of this embodiment is used as the surface sheet of an absorbent article, for example. Also, even if the raised ridge portions 2 are crushed under excessive external pressure, the spaces formed by the groove portions 1 are easily maintained. Therefore, even if a predetermined liquid is excreted while external pressure is being applied, it is difficult for the liquid to spread widely across the surface. Furthermore, even in cases where the predetermined liquid, which has been absorbed into a part of the absorbent article and is now under external pressure and tries to flow back, the nonwoven fabric 110 surface is formed to be uneven so there is less surface area for contact between the nonwoven fabric 110 and the skin, making it difficult for the liquid to widely adhere to the skin.

The following will now explain how to measure the heights, pitches and widths of the groove portions 1 and raised ridge portions 2. For example, place the nonwoven fabric 110 on a table without any pressure applied to the nonwoven fabric 110, then use a microscope to take a sectional photograph or sectional image of the nonwoven fabric 110 and measure dimensions. Note that the sample nonwoven fabric 110 should be cut passing through the raised ridge portions 2 and the groove portions 1.

When measuring height (the distance in the thickness direction), measure from the lowest position (in other words, the table top) of the nonwoven fabric 110 to the highest positions of the raised ridge portions 2 and the groove portions 1 toward the upward direction.

Also, to measure pitches, measure the distance between peaks of adjacent raised ridge portions 2. Measure the groove portions 1 in the same way.

To measure widths, measure the maximum width of the bottom face of the raised ridge portions 2 from the lowest position (in other words, the table top) of the nonwoven fabric 110 toward the upward direction. Measure the maximum width of the bottom face of the groove portions 1 in the same way.

There is no particular limitation to the shapes of the raised ridge portions 2. For example, dome shapes, trapezoidal shapes, triangular shapes, Ω shapes, and square shapes are all possible. To enhance the feel of the nonwoven fabric 110 against the skin, it is preferred that the area near the peak of the raised ridge portions 2 and the sides be curved surfaces. Also, to maintain the spaces of the groove portions 1 when the raised ridge portions 2 are crushed by external pressure, it is preferred that the widths of the raised ridge portions 2 be narrower from the bottom face to the peak surface. A preferred shape of the raised ridge portion 2 is a curved line (curved surface) such as a substantial dome shape.

1-2. Fiber Orientation

As shown in FIGS. 2A, B and FIG. 3, areas are formed with different content percentages of fibers oriented in a first direction (longitudinally-oriented fibers) which oriented a predetermined longitudinal direction of the nonwoven fabric that are included in the fibers 101 composed the nonwoven fabric 110. Each of the areas with different content percentages include the groove portions 1, and the sides 8 and center portion 9 that compose the raised ridge portions 2, for example.

Here, orienting the fibers 101 in the first direction (the longitudinal direction) means that the fibers 101 are oriented within a +45° to −45° range with regard to a predetermined longitudinal direction, which is the direction (the machine direction, or MD) in which the nonwoven fabric or fiber web are fed via the machine that manufactures the nonwoven fabric. Fibers oriented to the first direction are called the longitudinally-oriented fibers. Furthermore, orienting the fibers 101 in a second direction (the cross direction) means that the fibers 101 are oriented within a +45° to −45° range with regard to a predetermined width direction, which is perpendicular direction (the cross direction, or CD) to the MD direction. Fibers oriented to the second direction are called the laterally-oriented fibers.

The sides 8 of the nonwoven fabric 110 are areas on both sides of the raised ridge portions 2. The fibers 101 at the sides 8 are formed so that the content percentage of the longitudinally-oriented fibers is higher than the content percentage of the longitudinally-oriented fibers at the central portion 9 (the area sandwiched by the sides 8 on the raised ridge portions 2). For example, the content percentage of fibers oriented toward the longitudinal direction at the sides 8 is between 55 to 100%; more preferably between 60 to 100%. If the content percentage of the longitudinally-oriented fibers at sides 8 is less than 55%, it is possible for the sides 8 to experience stretching because of line tension. Also, the stretching of the sides 8 also causes stretching of the groove portions 1 and the central portion 9, described below, by line tension.

The central portions 9 are areas sandwiched by the sides 8 on both sides of the raised ridge portions 2. These are areas where the content percentage of the longitudinally-oriented fibers is lower than the sides 8. It is preferred that the longitudinally-oriented fibers and the laterally-oriented fibers be moderately mixed at the central portions 9.

For example, the content percentage of the longitudinally-oriented fibers of the central portions 9 is a minimum of 10% less than the content percentage of the longitudinally-oriented fibers of the sides 8, and is a minimum of 10% greater than the content percentage of the longitudinally-oriented fibers in the bottom portion of the groove portions 1, described below. Specifically, it is preferred that the content percentage of the longitudinally-oriented fibers at the central portions 9 is in a range between 40 to 80%.

The groove portions 1, as described above, are areas where the fluid (for example, hot air) composed mainly of gas is directly blown upon, so the longitudinally-oriented fibers at the groove portions 1 are blown to the sides 8. The laterally-oriented fibers remain at the groove portions 1. For that reason, the content percentage of the laterally-oriented fibers is greater at the groove portions 1 than that of the longitudinally-oriented fibers.

For example, the content percentage of fibers oriented toward the longitudinal direction at the groove portions 1 is a minimum of 10% less than the content percentage of the laterally-oriented fibers at the central portions 9. Therefore, the content percentage of the longitudinally-oriented fibers is the least and the content percentage of the laterally-oriented fibers is the greatest at the groove portions 1 at the nonwoven fabric 110. Specifically, the content percentage of the laterally-oriented fibers is between 55 to 100%; preferably between 60 to 100%. When the content percentage of the laterally-oriented fibers is less than 55%, the basis weight of the groove portions 1, as described below, is low, so it is more difficult to increase the strength of the nonwoven fabric in the width direction. When doing so, if the nonwoven fabric 110 is used as the surface sheet of an absorbent article, for example, friction with a body during use of the absorbent article causes it to be misdirected to the width direction, and there is the danger that it can be damaged.

Following is an outline of the method used to measure fiber orientation with a digital microscope VHX-100 made by Keyence Corporation. (1) Set a sample so that the length direction is in the proper direction on the observation stage. (2) Focus the lens on the fibers at the front of the sample, excluding the fibers that irregularly protrude to the front. (3) Set photographic depth (to the back) and create a 3D image on a PC monitor. Next, (4) convert the 3D image into a 2D image. (5) Draw a plurality of equally spaced, parallel lines on the monitor at any suitable time in the length direction in the range to measure. (6) In each fragmented cell drawn with parallel lines and observe whether the fiber orientation is in the first direction (length direction) or in the second direction (width direction) then measure the number fibers facing each direction. Then, (7) calculate the ratio of the number of fibers in the fiber orientation facing the first direction (the length direction) and the ratio of the number of fibers in the fiber orientation in the second direction (width direction) for the entire number of fibers in the set range to measure and calculate.

1-3. Fiber Compression

As shown in FIG. 3, the fiber density is adjusted to be less at the groove portions 1 compared to the raised ridge portions 2. Also, the fiber density of the groove portions 1 can be freely adjusted by several conditions, such as the amount of blown fluid (for example hot air) composed of mainly gas, and the tension. Also, the raised ridge portions 2 are formed to have a greater fiber density than the fiber density of the groove portions 1.

The fiber density at the bottom of the groove portions 1, specifically is a maximum of 0.18 g/cm$^3$; preferably between 0.002 to 0.18 g/cm$^3$; more preferably between 0.005 to 0.05 g/cm$^3$. When the fiber density of the bottom portion of the groove portions 1 is less than 0.002 g/cm$^3$, and the nonwoven fabric 110 is used in an absorbent article, for example, the nonwoven fabric 110 can be easily damaged. If the fiber density at the bottom portion of the groove portions 1 is greater than 0.18 g/cm$^3$, it is difficult for the liquid to travel downward and will be retained at the groove portions 1, giving the user a moist sensation.

Fiber density is adjusted to be greater at the raised ridge portions 2 compared to the groove portions 1. Furthermore, the fiber density of the raised ridge portions 2 can be freely adjusted by several conditions, such as the amount of blown fluid (for example hot air) composed of mainly gas, and the tension.

Fiber density at the central portions 9 of the raised ridge portions 2 is between 0 to 0.20 g/cm$^3$; preferably between 0.005 to 0.20 g/cm$^3$; more preferably between 0.007 to 0.07 g/cm$^3$ for example. If the fiber density of the central portions 9 is less than 0.005 g/cm$^3$, not only is it easier for the central portions 9 to be crushed by the weight of the liquid contained in the central portions 9 or by external pressure, but it also becomes easier for the liquid once absorbed in the absorbent article to reverse back, under the applied pressure. If fiber density at the central portions 9 is greater than 0.20 g/cm$^3$, it is difficult for the liquid contained at the central portions 9 to travel downward and will be retained in the groove portions 9, giving the user a moist sensation.

Furthermore, fiber density at the sides 8 of the raised ridge portions 2 can be freely adjusted by several conditions, such as the amount of blown fluid (for example hot air) composed of mainly gas, and the tension. Specifically, the fiber density of the sides 8 is between 0 to 0.40 g/cm$^3$; preferably between 0.007 to 0.25 g/cm$^3$; more preferably 0.01 to 0.20 g/cm$^3$ for example. If fiber density at the sides 8 is less than 0.007 g/cm$^3$, there are cases that the sides 8 will become stretched by line tension. If fiber density at the central portions 8 is greater than 0.40 g/cm$^3$ it is difficult for the liquid contained at the sides 8 to travel downward. Thus, the liquid will be retained at the sides 8, giving the user a moist sensation.

1-4. Basis Weight

The average basis weight of the overall fiber of the nonwoven fabric 110 is between 10 to 200 g/m$^2$; preferably 20 to 100 g/m$^2$. For example, if the nonwoven fabric 110 are used in the surface sheet of an absorbent article, and the average basis weight is less than 10 g/m$^2$, the surface sheet can be easily damaged while in use. Also, if the average basis weight of the nonwoven fabric 110 is greater than 200 g/m$^2$, it is difficult for liquid to move downward.

As shown in FIG. 3, the basis weight of the fibers 101 at the groove portions 1 is adjusted to be less compared to the raised ridge portions 2. Also, the basis weight of the bottom portion of the groove portions 1 is adjusted so that it is less compared to the average basis weight of entire nonwoven fabric including the bottom portion of the groove portions 1 and the raised ridge portions 2. Specifically, the basis weight of the bottom of the groove portions 1 is between 3 to 150 g/m$^2$; preferably between 5 to 80 g/m$^2$. If the basis weight of the bottom portion of the groove portions 1 is less than 3 g/m$^2$, and the nonwoven fabric 110 are used as the surface sheet of an absorbent article, for example, the surface sheet can be easily torn during use. If the basis weight of the bottom of the groove portions 1 is greater than 150 g/m$^2$, it is difficult for the liquid contained at the groove portions 1 to travel downward and will be retained in the groove portions 1, giving the user a moist sensation.

The average basis weight of the fiber 101 at the raised ridge portions is adjusted to be greater compared to the groove portions 1. The basis weight of the central portions 9 at the raised ridge portions 2 is between 15 to 250 g/m$^2$; preferably between 20 to 120 g/m$^2$. If the basis weight of the central portions 9 is less than 15 g/m$^2$, not only is it easier for the central portions 9 to be crushed by the weight of the liquid contained at the central portions 9 or by external pressure, but it also becomes easier for the liquid absorbed in the absorbent article to reverse back, under the applied pressure. If the basis weight of the central portions 9 is greater than 250 g/m$^2$, it is difficult for the liquid to travel downward and will be retained at the central portions 9, giving the user a moist sensation.

Furthermore, the basis weight at the sides 8 of the raised ridge portions 2 can be freely adjusted by several conditions, such as the amount of blown fluid (for example hot air) composed of mainly gas, and the tension. Specifically, the basis weight at the sides 8 is between 20 to 28 g/m$^2$; preferably between 25 to 150 g/M$^2$. If the basis weight at the sides 8 is less than 20 g/m$^2$, there is the possibility of the sides 8 experiencing stretching caused by line tension. If the basis weight at the sides 8 is greater than 280 g/m$^2$ it is difficult for the liquid contained at the sides 8 to travel downward and will be retained in the sides 8, giving the user a moist sensation.

Also, the basis weight at the bottom of the groove portions 1 is adjusted so that it is less compared to the average basis weigh t of entire nonwoven fabric of the raised ridge portions 2 composed of the sides 8 and the central portions 9. For example, the basis weight at the bottom of the groove portions 1 is a maximum of 90% of the average basis weight of the raised ridge portions 2; between 3 to 90%; more preferably between 3 to 70%. If the basis weight at the bottom of the groove portions 1 is greater than 90% of the average basis weight of the raised ridge portions 2, there will be greater resistance to the liquid which has seeped into the groove portions 1 to move downward of the nonwoven fabric 110, which can cause the liquid to leak from the groove portions 1. If the basis weight at the bottom portion of the groove portions 1 is less than 3% with regard to the average basis weight of the raised ridge portions 2, and the nonwoven fabric is used as the surface sheet of an absorbent article, for example, the surface sheet can be easily damaged during use of the absorbent article.

1-5. Others

If the nonwoven fabric of this embodiment is used to absorb or to allow the penetration of predetermined liquids, the groove portions 1 will allow the easy penetration of the liquid and the raised ridge portions 2 having a porous structure, make it difficult to retain the liquid.

The fiber density of the fibers 101 of the bottom portion of the groove portions 1 is greater compared to the other areas and the basis weight is low, so it is appropriate for the penetration of liquid. Furthermore, the fibers 101 at the bottom portion of the groove portions 1 are oriented in the width direction so it is possible to prevent the liquid from flowing too far in the length direction of the nonwoven fabric 110 in the groove portions 1 and spreading widely. The fibers 101 are oriented in the width direction (CD orientation) of the groove portions 1, so regardless of the fact that the basis weight is less compared to other areas, the strength of the nonwoven fabric in the width direction (CD strength) is increased.

The raised ridge portions 2 are adjusted so their basis weights are greater compared to other areas, and because this increases the number of fibers, the number of fusion points also increases and the porous structure is maintained.

Also, the content percentage of the laterally-oriented fibers of the bottom portion of the groove portions 1 is greater than that at the central portions 9, and the content percentage of the longitudinally-oriented fibers at the sides 8 is greater than that at the central portions 9. Also, there are more fibers 101 oriented in the thickness direction at the central portions 9 than the groove portions 1 and sides 8. This places a load in the thickness direction, for example, on the central portions 9 that reduces the thickness of the raised ridge portions 2, but if the load is freed, it will easily return to its original height because of the stiffness of the fibers 101 oriented in the thickness direction. In other words, these are nonwoven fabric that has high compression recoverability.

1-6. Manufacturing Method

The method for manufacturing the nonwoven fabric 110 of this embodiment will be explained below with reference to FIGS. 4A to 9. First, the fiber web 100 is placed on a top surface of the mesh supporting member 210 which is an air-permeable support member. Said another way, the fiber web 100 is supported from a bottom side by the mesh supporting member 210.

As shown in FIG. 5, it is possible to manufacture the nonwoven fabric 110 of this embodiment by moving the mesh supporting member 210 in a predetermined direction while supporting the fiber web 100 and continuously blowing a gas from a top side of the fiber web 100 as it is being moved.

The mesh supporting member 210 is formed by weaving a plurality of wires 211 of a predetermined thickness, which are non-air-permeable portions. By weaving the plurality of wires 211 to leave a predetermined space open, the mesh supporting member formed with a plurality of air-permeable holes 213 is obtained.

The mesh supporting member 210 in FIGS. 4A and 4B is formed with a plurality of holes 213 that have small diameters. The gas blows from the top side of the fiber web 100 and passes downward unhindered by the mesh supporting member 210. This mesh supporting member 210 prevents the fibers 101 from moving to a downward direction of the mesh supporting member 210 but does not greatly vary the flow of the fluid composed mainly of a gas being blown.

For that reason, the fibers 101 that compose the fiber web 100 are moved in a predetermined direction by the gas blow mainly from the top side. Specifically, downward movement is limited by the mesh supporting member 210 so the fibers 101 are moved in a direction along the surface of the mesh supporting member 210.

For example, the fibers 101 in the area blown by the gas are moved from that area to an area not blown by the gas in the surrounding area. Then, the area blown by the gas moves in a predetermined direction, so an area is formed on the fibers 101 where gas is continuously blown in a predetermined direction. The result is that the fibers 101 move to side directions in the consecutive areas.

This causes the groove portions 1 to be formed and the fibers 101 of the groove portions 1 to be moved and oriented in the width direction. Also, the raised ridge portions 2 are formed between the two adjacent groove portions 1 and 1, the fiber density of the sides in the raised ridge portions 2 increases and the fibers 101 become oriented in the length direction.

As shown in FIGS. 6 to 9, the nonwoven fabric manufacturing apparatus 90 that manufactures the nonwoven fabric 110 of this embodiment is provided with the air-permeable support member 200, and blowing means composed of a blowing unit 910 and an air pipe, not shown. The air-permeable support member 200 is configured to support the fiber web 100, which is the fiber aggregate, from one side. The blowing unit 910 is configured to blow a fluid composed mainly of a gas from the other side of the fiber web 100. The air pipe is configured to feed the fluid, composed mainly of a gas, to the blowing unit 910.

Here, in the nonwoven fabric manufacturing apparatus 90, the nonwoven fabric 110 is formed while the fiber web 100 is being sequentially moved by moving means. The moving means moves the fiber web 100 in a predetermined direction while the fiber web 100 is supported at one side by the air-permeable support member 200. Specifically, the fiber web 100 is moved in a predetermined direction F while being blown by a fluid mainly composed of a gas. As moving means, an example is a conveyor 930 shown in FIGS. 6 and 7. The conveyor 930 is equipped with air-permeable belt 939 formed to a lateral, ring-shape mounted with the air-permeable support member 200, and rotors 931 and 933 arranged at both ends in the length direction, at the inner side of the air-permeable belt, that rotate the air-permeable belt 939 in a predetermined direction.

The air-permeable support member 200 can be suitably replaced depending on the nonwoven fabric to be manufactured. For example, to manufacture the nonwoven fabric 110 of this embodiment, it is possible to use the mesh supporting member 210 described above as the air-permeable support member 200. The following will now explain using the mesh supporting member 210 described above as the air-permeable support member 200.

The conveyor 930, as described above, moves the mesh supporting member 210 while it is supporting the fiber web 100 from the bottom side thereof. Specifically, as shown in FIG. 8, the fiber web 100 is moved to pass the bottom side of the blowing unit 910. In addition, the fiber web 100 is moved to pass the inside of a heater unit 950, which is a heating means, and is opened at both sides.

The blowing means is provided a pneumatic unit, not shown, and the blowing unit 910. The pneumatic unit, not shown, is linked to the blowing unit 910 via the air pipes 920. The air pipes 920 are connected to enable the passing of air to an upper side of the blowing unit 910. As shown in FIG. 9, the blowing unit 910 is formed with a plurality of jet holes 913 at predetermined spaces.

The gas that is fed from the pneumatic unit, not shown, to the blowing unit 910 via the air pipes 920 is linked blown out from the plurality of jet holes 913. The gas blown out from the plurality of jet holes 913 is blown continuously onto the top surface of the fiber web 100. Specifically, the gas blown out from the plurality of jet holes 913 is blown continuously onto the top surface of the fiber web 100 being moved in the predetermined direction F by the conveyor 930.

A suction unit 915 arranged at a bottom side of the mesh supporting member 210, below the blowing unit 910, takes in the gas blown from the blowing unit 910 and passed through the mesh supporting member 210. By taking in the gas by the suction unit 915, it is possible to position the fiber web 100 to stick to the mesh supporting member 210.

The suction by the suction unit 915 can be of a strength to the degree that the fibers 101 of the areas being blown by the fluid, composed mainly of a gas, are pushed to the mesh supporting member 210. It is possible to prevent the shape of the fiber web 100 from becoming disarrayed by the fluid, composed of mainly a gas, striking the non-air-permeable portions (the wire 211 of the mesh supporting member 210) of the air-permeable support member 200 and rebounding, by suctioning the fluid, composed of mainly a gas, by the suction unit 915. It is possible to convey to inside the heater unit 950 while maintaining the shape of the grooves (concave/convex portion) formed by air current. It is preferred that the suction by the suction unit 915 be performed until the fiber web 100 is conveyed into the heater unit 950.

Also, by drawing in the fluid, composed mainly of a gas, from the bottom side of the mesh supporting member 210, the fibers of the area being blown by the fluid composed, mainly of a gas, are moved by being pushed to the mesh supporting member 210 side, so the fibers collect at the mesh supporting member 210 side. Also, at the raised ridge portions 2, by the fluid, composed mainly of a gas, which is being blown striking and rebounding from the non-air-permeable portion (the wires 211 of the mesh supporting member 210) of the air-permeable support member 200, the fibers 101 partially align toward the thickness direction.

The temperature of the fluid, composed mainly of a gas, blown from each of the jet holes 913 can be at room temperature, but to enable good formability of the groove portions (concave/convex), for example, it is possible to adjust the temperature to above the softening point of at least the thermoplastic fibers that compose the collection of fibers, and preferably above the softening point, to a temperature between +50° C. and −50° C. of the melting point. Because the fiber itself loses repulsive force when the fibers are softened, the y can easily maintain their rearranged shapes by an air current. If the temperature is raised even further, the fibers will begin to melt together, making them maintain the shape of the groove portions (concave/convex) even more. This makes it possible to convey the fiber web to inside the heater unit 950 while maintaining the shape of the grooves (concave/convex).

Note that the airflow rate and temperature of the fluid, composed mainly of a gas being blown, and the amount of suction, the permeability of the mesh supporting member 210, and the adjustment of the basis weight of the fiber web 100 can vary the shapes of the raised ridge portions 2. For example, if the amounts of the fluid, composed mainly of a gas, being blown and being taken in (drawn in) are substantially equal, or if there is a greater amount of fluid, composed mainly of a gas, being taken in (drawn in), the backside of the raised ridge portions 2 of the nonwoven fabric 115 (nonwoven fabric 110) is formed according to the shape of the mesh supporting member 210. Therefore, if the mesh supporting member 210 is flat, the backside of the nonwoven fabric 115 (nonwoven fabric 110) would also be flat.

Also, it is possible to convey to the heater unit 950 while maintaining the shapes of the groove portions (concave/convex) formed by the air current, either by conveying to the inside of the heater 950 immediately after forming the groove portions (concave/convex) formed by the air current or at the same time, or cooling immediately forming the groove portions (concave/convex) with hot air (an air current of a predetermined temperature) then conveying to the heater unit 950.

The heater unit 950 which is the heating means, has both ends open in the predetermined direction F. The fiber web 100 (nonwoven fabric 110) set on the mesh supporting member 210 conveyed by the conveyor 930 is continuously moved with a predetermined time retained in the heated space formed inside the heater 950. For example, if the fibers 101 composing the fiber web 100 (nonwoven fabric 110) include thermoplastic fibers, it is possible to obtain nonwoven fabric 115 (nonwoven fabric 110) where fibers 101 are joined together by heat in the heater unit 950.

2. OTHER EMBODIMENTS

The following will now explain other embodiments of the nonwoven fabric of the present invention. Note that the portions that are not particularly explained in relation to the other embodiments are the same as the first embodiment of the nonwoven fabric. If the numbers applied in the drawings are the same as the first embodiment, the same numbers will also be applied to these embodiments.

FIGS. 10 to 15 explain the second embodiment of the nonwoven fabric of the present invention. The overall shapes of the nonwoven fabric in the second embodiment are different compared to the first embodiment. The shapes of the surfaces opposite to the surfaces formed by the raised ridge portions in the third embodiment are different compared to the first embodiment. The shapes of the raised ridge portions in the fourth embodiment are different compared to the first embodiment. The point that openings are established in the groove portions 1 in the fifth embodiment is different compared to the first embodiment.

2-1. Second Embodiment

FIGS. 10 and 11 explain the second embodiment of the nonwoven fabric of the present invention.

2-1-1. Nonwoven Fabric

As shown in FIGS. 10 and 11, the nonwoven fabric 116 of the second embodiment are different from the first embodiment in the point that the overall nonwoven fabric 116 are rolling in a wave shape. The following will now explain the points that are different to the first embodiment.

The nonwoven fabric 116 of the second embodiment has rolling wave-shapes substantially perpendicular to the direction that the groove portions 1 and raised ridge portions extend.

2-1-2. Manufacturing Method

The method for manufacturing the nonwoven fabric 116 of the second embodiment is the same as the method used for the first embodiment, but the configuration of a mesh supporting member 260 that is the air-permeable support member is different. The mesh supporting member 260 of the second embodiment is formed by weaving a plurality of wires 261 of a predetermined thickness, which are non-air-permeable. By weaving the plurality of wires 261 to leave predetermined spaces open, the mesh supporting members 260 formed of a plurality of air-permeable holes 263 is obtained.

Also, in the second embodiment, the mesh supporting member 260 are formed to have alternately rolling waves in a parallel direction of a Y axis, as shown in FIG. 11, for example. In other words, the mesh supporting member 260 is a support member having rolling waves in a parallel direction on either the short direction or the long direction of the mesh supporting member 260.

The mesh supporting member 260 in FIG. 11 is formed with a plurality of holes 263 that have small diameters, and the gas blows from the top side of the fiber web 100 passing downward unhindered by the mesh supporting member 260. This mesh supporting member 260 does not allow the fibers 101 to move to a downward direction of the mesh supporting member 260 without greatly varying the flow of the fluid composed mainly of a gas being blown.

Furthermore, the mesh supporting member 260 itself has rolling waves, so the fiber web 100 is formed to a shape having rolls according to the shape of the mesh supporting member 260 by the fluid composed mainly of a gas blown from the top side of the fiber web 100.

It is possible to form the nonwoven fabric 116 by moving the fiber web 100 along the axis X direction while blowing the fluid composed mainly of a gas on the fiber web 100 set on the top surface of the mesh supporting member 260.

The form of the rolling appearance in the mesh supporting member 260 can be freely set. For example, as shown in FIG. 11, the pitches between peaks of rolls in the axis X direction are between 1 to 30 mm; preferably between 3 to 10 mm. Also, the level differences between the top and bottom portions of the rolls in the mesh supporting member 260 are between 0.5 to 20 mm; preferably between 3 to 10 mm. Furthermore, the shape of the cross-section of the axis X direction of the mesh supporting member 260 is not limited to a wave shape, as shown in FIG. 11. It is possible for each vertex of the peak portions and bottom portions of the rolls to be a series of substantial triangular shapes forming sharp angles, or a series of concave and convex shapes that are substantially square-shapes so that each vertex of the peak portions and bottom portions are substantially flat.

It is possible to manufacture the nonwoven fabric 116 of the second embodiment using the nonwoven fabric manufacturing apparatus 90 described above. The explanations of the manufacturing method of the nonwoven fabric 110 and the nonwoven fabric manufacturing apparatus 90 can be of reference for the manufacturing method of the nonwoven fabric 116 in the nonwoven fabric manufacturing apparatus 90.

2-2. Third Embodiment

FIG. 12 explains the third embodiment of the nonwoven fabric of the present invention.

As shown in FIG. 12, the shapes of the surfaces opposite to the surfaces formed with the raised ridge portions 2 of the nonwoven fabric 140 are different from those of the first embodiment. The following will now explain the points that are different to the first embodiment.

2-2-1. Nonwoven Fabric

The groove portions 1 and raised ridge portions 2 are alternately formed in parallel on the first surface side of the nonwoven fabric 140 of the third embodiment. Also, the area of the bottom surface of the raised ridge portions 2 is formed to project to the side that the raised ridge portions 2 projects, on the second surface side of the nonwoven fabric 140. Said another way, the areas of the bottom surfaces on the second side of the raised ridge portions 2 of the nonwoven fabric 140 form indented concave portions. Also, the areas of the second side at the bottom surface on the opposite side of the groove portions 1 are formed to convex portions that project to an opposite direction of the convex portion of the first side.

2-2-2. Manufacturing Method

In the third embodiment, the fiber web 100 is placed on the mesh supporting member 210 and moved along a predetermined direction while fluid, composed mainly of a gas, is blown on the fiber web, and the fluid, composed mainly of a gas, being blown is taken in (drawn in) from the bottom side of the mesh supporting member 210. Also, the amount of fluid, composed mainly of a gas, that is taken in (drawn in) is less than the amount of the fluid, composed mainly of a gas, that is blown. If the fluid, composed mainly of a gas, that is blown is more than the fluid, composed mainly of a gas, that is taken in (drawn in), the fluid, composed mainly of a gas, that is blown slightly rebounds which can form the under surface side (bottom surface side) of the raised ridge portions 2 to project in the same direction as the raised ridge portions 2 of the top surface side of the raised ridge portions 2.

The manufacturing method of the nonwoven fabric 140 of the third embodiment is the same as the one described in relation to the first embodiment. The support members used in the manufacturing of the nonwoven fabric 140 can use the same ones as the mesh supporting member 210 in the first embodiment.

2-3. Fourth Embodiment

FIG. 13 explains the fourth embodiment of the nonwoven fabric of the present invention.

As shown in FIG. 13, the nonwoven fabric 150 differ from the form of the first embodiment in the point that raised ridge portions 2 and a second raised ridge portions 22 are formed having different heights on a first surface side of the nonwoven fabric 150. The following will explain the points that are different to the first embodiment.

2-3-1. Nonwoven Fabric

The nonwoven fabric 150 of the fourth embodiment is nonwoven fabric formed with a plurality of groove portions 1 on the first surface side of the nonwoven fabric 150. A plurality of raised ridge portions 2 is formed between each of a plurality of groove portions 1 formed at substantially equal spacing. Also, a plurality of the second raised ridge portions 22 is alternately formed sandwiching the plurality of groove portions 1, between each of the adjacent plurality of raised ridge portions 2 that were sandwiching the plurality of groove portions 1. Said another way, the raised ridge portions 2 and second raised ridge portions 22 are alternately formed in parallel sandwiching the plurality of groove portions 1.

The raised ridge portions 2 and second raised ridge portions 22 are areas that are not blown by the fluid, composed mainly of a gas, at the fiber web 100. They are areas that project relatively to the top side by forming the groove portions 1. The height of the second raised ridge portions 22 in the thickness direction of the nonwoven fabric 150 is less than the raised ridge portions 2. The length in the width direction is also formed to be narrow, but the fiber density, fiber orientation and basis weight are configured to be the same as the raised ridge portions 2.

The raised ridge portions 2 and the second raised ridge portions 22 in the nonwoven fabric 150 were formed between each of the plurality of parallel formed groove portions 1. The raised ridge portions 2 is formed adjacent to the second raised ridge portions 22 sandwiching the groove portions 1. The second raised ridge portions 22 is formed adjacent to the raised ridge portions 2 sandwiching the groove portions 1. In other words, the raised ridge portions 2 and the second raised ridge portions 22 are alternately formed sandwiching the groove portions 1. Specifically, the pattern of raised ridge portions 2, groove portions 1, second raised ridge portions 22, groove portions 1, raised ridge portions 2 is repeatedly formed. Note that the positional relationships of the raised ridge portions 2 and the second raised ridge portions 22 are not limited to this pattern. It is also possible to form a plurality of raised ridge portions 2 to be adjacent sandwiching the groove portions 1 on at least a portion of the nonwoven fabric 150. It is also possible to form a plurality of adjacent second raised ridge portions 22 sandwiching the groove portions 1.

2-3-2. Manufacturing Method

The manufacturing method for the nonwoven fabric 150 of the fourth embodiment, compared to the manufacturing method of the nonwoven fabric of the first embodiment, is different in the form of the blowing nozzles 913 of the nonwoven fabric manufacturing apparatus 90.

The nonwoven fabric 150 of the fourth embodiment are formed by moving the fiber web 100 placed on the mesh supporting member 210 while blowing a fluid, composed mainly of a gas, on the fiber web 100. The groove portions 1, raised ridge portions 2 and the second raised ridge portions 22 are formed when the fluid, composed mainly of a gas, is blown, and these formations can be freely changed depending on the blowing nozzles 913 of the fluid, composed mainly of a gas, in the nonwoven fabric manufacturing apparatus 90.

The nonwoven fabric 150 shown in FIG. 13 can be manufactured by the nonwoven fabric manufacturing apparatus 90 by adjusting the spacing of the blowing nozzles 913. For example, by narrowing the space of the blowing nozzles 913 more than the blowing nozzles 913 of the first embodiment, it is possible to form the second raised ridge portions 2 with a lower thickness direction than the raised ridge portions 2. Also, by widening the space of the blowing nozzles 913 more than the blowing nozzles 913 of the first embodiment, it is possible to form raised ridge portions with a higher thickness direction than the raised ridge portions 2. Also, in the space formed by the blowing nozzles 913, by alternately arrange a narrow space and a wide space, the raised ridge portions 2 and second raised ridge portions 22 can be alternately arranged on the nonwoven fabric 150 sandwiching the groove portions 1. The spacing of the blowing nozzles 913 is not meant to be limited to this configuration. It is possible to freely form the heights of the raised ridge portions of the nonwoven fabric and to orient the second raised ridge portions 22.

It is possible to manufacture the nonwoven fabric 150 of the fourth embodiment using the nonwoven fabric manufacturing apparatus 90 as described above, but it is possible to refer to the explanations of the manufacturing method of the nonwoven fabric 110 and the nonwoven fabric manufacturing apparatus 90 for other configurations in the manufacturing methods of the nonwoven fabric 150 using the nonwoven fabric manufacturing apparatus 90.

2-4. Fifth Embodiment

FIGS. 14 and 15 explain the fifth embodiment of the nonwoven fabric of the present invention.

As shown in FIGS. 14 and 15, the nonwoven fabric 170 of the fifth embodiment differ from the first embodiment in the point that indentation 3A and projection 4A are formed in the groove portions 1 formed on one surface side of the nonwoven fabric 170. The following will explain the points that are different to the first embodiment.

2-4-1. Nonwoven Fabric

As shown in FIG. 14, a plurality of groove portions 1 are formed in parallel at substantially equal spaces at a first surface side of the nonwoven fabric 170 of the fifth embodiment. Also, each of a plurality of raised ridge portions 2 is formed between each of a plurality of groove portions 1. Furthermore, in the groove portions 1, a plurality of indentation 3A is formed at substantially equal spaces along the groove portions 1, and each of a plurality of projection 4A is formed between each of the plurality of indentation 3A.

In the fifth embodiment, the indentation 3A is formed at substantially equal spaces, but the spacing is not limited to that and can be a different space. As shown in FIG. 14, the indentation 3A show openings, but this can vary according to conditions such as the amount and strength of the fluid, composed mainly of a gas, being blown, and the amount of suction.

The heights in the thickness direction of the nonwoven fabric 170 in the indentation 3A is no greater than 90% of the height in the thickness direction of the nonwoven fabric of the projection 4A, preferably between 0 to 50%; more preferably between 0 to 20%. Here the height of 0% indicates that the indentation 3A is an opening.

The lengths in the length direction and the width direction of one indentation 3A are between 0.1 to 30 mm; preferably between 0.5 to 10 mm. Also, the pitches of adjacent indentation 3A mutually sandwiching the projection 4A are between 0.5 to 30 mm; preferably between 1 to 10 mm.

The heights in the thickness direction of the nonwoven fabric 170 at the projection 4A are equal to or less than the heights in the thickness direction of the nonwoven fabric 170 of raised ridge portions 2, preferably between 20 to 100%; more preferably between 40 to 70%.

Also, the lengths of the nonwoven fabric 170 of projection 4A in the length and the width directions are between 0.1 to 30 mm; preferably between 0.5 to 10 mm. The pitches of adjacent projection 4A mutually sandwiching the indentation 3A are between 0.5 to 30 mm; preferably between 1 to 10 mm.

The cross-sectional shape in the length direction of the nonwoven fabric of the projection 4A is substantially a square shape. Note that the cross-sectional shape in the length direction of projection 4A is not limited to being a square. It is not limited to being a dome shape, trapezoidal shape, triangular shape, or Ω shape, but to suppress the spreading of the predetermined liquid in the groove portions 1, a substantial square shape is preferred. Also, to prevent foreign-body sensation by the projection 4A touching the skin under excessive external pressure, the peak surface of the projection 4A is preferred to be a plane or a curved surface.

Also, the cross-sectional shape in the length direction of the nonwoven fabric of the indentation 3A can be dome-shaped, trapezoid-shaped, Ω shaped, or square shaped, or the inversion of these shapes. There is no particular limitation to the shape. If the indentation 3A is an opening, it is preferred because it suppresses the spreading of the predetermined liquid in the groove portions 1, even if excess external pressure is applied or a predetermined liquid with a high viscosity is charged.

The fibers of the projection 4A in the groove portions 1 are oriented along the width direction of the overall groove portions 1.

If the indentation 3A is an opening, the fluid, composed mainly of a gas, that is blown causes the longitudinally-oriented fibers to be blown to the raised ridge portions 2 side, or the laterally-oriented fibers to be blown to the projection 4A side, in the region that is the opening. Therefore, the fibers 101 in the area around the opening are oriented to envelope the surrounding of the opening. For that reason, it is difficult for the opening to be crushed and plugged even when external pressure is applied.

Also, the projection 4A is formed with a greater fiber density than the indentation 3A.

The fiber densities of the indentation 3A and projection 4A are freely adjusted depending on conditions such as the amount of the blown fluid composed mainly of a gas, and the tension, in the same way as the raised ridge portions 2 and groove portions 1 of the first embodiment. Note that the indentation 3A does not have to be an opening.

The fiber density of the indentation 3A is a maximum of 0.20 g/cm$^3$; preferably between 0.0 to 0.10 g/cm$^3$. Here, the fiber density of 0.0 g/cm$^3$ indicates that the indentation 3A is an opening. If the fiber density of the indentation 3A is greater than 0.20 g/cm$^3$, the predetermined liquid charged to the groove portions 1 can build-up once in the indentation 3A.

The fiber density of the projection 4A is between 0.005 to 0.20 g/cm$^3$; preferably between 0.007 to 0.10 g/cm$^3$. If the fiber density of the projection 4A is less than 0.005 g/cm$^3$, and the raised ridge portions 2 are crushed under excess external pressure, the projection 4A would also be crushed, making it difficult to maintain a space formed by the indentation 3A in the groove portions 1.

On the other hand, if the fiber density of the projection 4A is greater than 0.20 g/cm$^3$, the predetermined liquid charged to the groove portions 1 will build-up in the projection 4A, and if it directly touches the skin because of excess external pressure applied to the nonwoven fabric 170, the user would experience a moist sensation.

The indentation 3A in the groove portions 1 is formed to have a lower basis weight of the fibers 101 compared to the raised ridge portions 2 and the projection 4A. In other words, the basis weight is formed to be lowest for the indentation 3A, in the nonwoven fabric 170.

The basis weight of the indentation 3A is between 0 to 100 g/m$^2$; preferably between 0 to 50 g/m$^2$. Here, the basis weight of the indentation 3A is 0 g/m$^2$ indicates that the indentation 3A is an opening. If the basis weight of the indentation 3A is greater than 100 g/m$^2$, the predetermined liquid charged to the groove portions 1 can build-up once in the indentation 3A.

Also, if the nonwoven fabric 170 are used as the surface sheet of an absorbent article, for example, and there are changes in behavior when the predetermined liquid has built-up in the indentation 3A, the predetermined liquid can easily leak from the indentation 3A and spread to the projection 4A, in the groove portions 1, and spread to the surface of the nonwoven fabric 170, causing the skin to be dirtied.

The projection 4A is formed with a greater basis weight compared than the indentation 3A. For example, the basis weight of the projection 4A is between 5 to 200 g/m$^2$; preferably between 10 to 100 g/m$^2$. If the basis weight of the projection 4A is less than 5 g/m$^2$, and the raised ridge portions 2 are crushed under excess external pressure, the projection 4A would also be crushed, making it difficult to maintain a space formed by the indentation 3A in the groove portions 1.

Also, if the basis weight of the projection 4A is greater than 200 g/m$^2$, the predetermined liquid dropped into the groove portions 1 will build-up in the projection 4A, and if it directly touched the skin because of excess external pressure applied to the nonwoven fabric 170, the user would experience a moist sensation.

2-4-2. Manufacturing Method

The following will explain the method for manufacturing the nonwoven fabric 170. First, the fiber web 100 is placed on a top surface of the supporting member 270 shown in FIG. 15 which is an air-permeable support member, in the same way as was described for the first embodiment. Said another way, the fiber web 100 is supported from a bottom side by the supporting member 270.

Also, the fiber web 100 is moved in a predetermined direction while being supported by the supporting member 270. It is possible to manufacture the nonwoven fabric 170 by blowing a fluid, composed mainly of a gas, from the top surface of the fiber web 100 being moved.

Here, the supporting member 270 is a spiral-weave air-permeable net formed by alternately wrapping wire 272 of a predetermined thickness around another wire 271 of a predetermined thickness lined up substantially parallel, to bridge a plurality of wires 271.

The portions of the wire 271 and 272 in the supporting member 270 are non-air-permeable. The portions surrounded by the wire 271 and 272 in the supporting member 270 are holes 273.

It is possible to vary air-permeability in portions by varying the weaving method, thickness of the wire, and the thread shapes in portions for this supporting member. For example, it is possible to use the supporting member 270 spirally weaved with the wire 217 as a round-shaped stainless steel thread, and the wire 272 as a flat stainless steel thread.

Note that it is possible for the wires 271 and 272, which are not air-permeable to allow the passage of a portion of the fluid, by creating gaps in the adjoined wires, of the plurality of wires (for example two wires) as the wires 271 and 272.

However, the degree of air-permeability of the non-air-permeable wires 271 and 272 (particularly the wire portion), is a maximum of 90% of the degree of air-permeability of the holes 273; preferably between 0 to 50%; more preferably between 0 to 20%. Here, 0% indicates that the fluid substantially cannot pass through.

Also, the degree of air-permeability of the areas such as the holes 273 that are the air ventilation portions is between 10,000 to 60,000 cc/cm$^2$·min; preferably between 20,000 to 50,000 cc/cm$^2$·min. However, if a vent is formed by cutting out a metal plate or the like, for example, as a air-permeable support member, the resistance of the fluid to the plate portion would be eliminated, so there would be air-permeability that is greater than the numerical values described above.

In the supporting member, it is preferable for the area that is not air-permeable to have a greater surface slippage than the area that forms the venting portion. By being highly slippery, it is easy for the fibers 101 to move in the area where the area being blown by the fluid, composed mainly of a gas, and the unventilated portion intersect so that it is possible to increase the formability of the indentation 3A and the projection 4A.

By blowing fluid, composed mainly of a gas, onto the fiber web 100 supported by the supporting member 270, the area being blown by the fluid, composed mainly of a gas, becomes the groove portions 1 and by forming the groove portions 1, the portion projecting relatively becomes the raised ridge portions 2. The forming of the groove portions 1 and raised ridge portions 2 is the same as was described in relation to the first embodiment.

Also, in the groove portions 1, if fluid, composed mainly of a gas, is blown at the intersecting portion of the wire 271 and the wire 272 in the supporting member 270, the fluid, composed mainly of a gas, rebounds at the intersecting portion. For that reason, the fibers 101 supported at the intersecting portion is blown to the front, back and left and right to form the indentation 3A.

Also, the groove portions 1 are formed by blowing fluid at the area on the upper surface of the hole 273 of the supporting member 270, and by forming the indentation 3A at the groove portions 1, the projection 4A that projects relatively is formed.

At the indentation 3A, by blowing fluid, composed mainly of a gas, the fibers 101 oriented substantially parallel in the groove portions 1 is blown to the raised ridge portions 2 side, and the fibers 101 oriented in the direction that intersects the extending direction of the groove portions 1 is blown to the projection 4A side. For that reason, the basis weight is less at the indentation 3A.

On the other hand, at the projection 4A, the fibers 101 are blown from the indentation 3A, forming the projection 4A with a greater basis weight than the indentation 3A.

Also, as another method for manufacturing the nonwoven fabric 170, first, manufacture the nonwoven fabric formed with the groove portions 1 and the raised ridge portions 2 as described in relation to the first embodiment, then it is possible to manufacture the nonwoven fabric 170 by forming the indentation 3A and projection 4A by applying an embossing finish to the groove portions 1. In this case, the relationship of the fiber density and the basis weight of the indentation 3A and the projection 4A is the opposite of the relationship described in relation to the present embodiment. In other words, the fiber density and basis weight of the projection 4A is less than the fiber density and basis weight of the indentation 3A.

As another method for manufacturing the nonwoven fabric 170, form concave and convex portions such as the raised ridge portions 2 and groove portions 1 in the fiber web 100 in advance. Then, it is possible to blow the fluid, composed mainly of a gas, onto another overlapped fiber web whose fibers have a degree of freedom. Thus, the raised ridge portions and groove portions are formed at the upper layer of fiber web by blowing fluid, but the concave and convex portions formed at the bottom layer of fiber web with a low basis weight at the groove portions are exposed, forming the projection and indentation of this embodiment. Then, heat treatment integrates the top layer of the fiber web and lower layer of fiber web.

It is possible to manufacture the nonwoven fabric 170 of this embodiment using the nonwoven fabric manufacturing apparatus 90 described above. The explanations of the manufacturing method of the nonwoven fabric 110 and the nonwoven fabric manufacturing apparatus 90 can be of reference for the manufacturing method of the nonwoven fabric 170 in the nonwoven fabric manufacturing apparatus 90.

3. WORKING EXAMPLES

3-1. First Working Example

Fiber Configuration

Use a blend of a fiber A (average fineness: 3.3 dtex; average fiber length: 51 mm) coated with a hydrophilic oil solution, having a core-sheath structure of a low-density polyethylene (melting point 110° C.) and polyethylene terephthalate, and fiber B (average fineness: 3.3 dtex; average fiber length: 51 mm) coated with a water-repellent oil solution, having a core-sheath structure of a high-density polyethylene (melting point 135° C.) and polyethylene terephthalate. The mixing ratio of the fiber A and the fiber B is 70:30, and use a fiber aggregate adjusted to a basis weight of 40 g/m$^2$.

There is a difference in melting points in the sheath ingredients of the fibers A and fibers B, and because there is a difference in strengths of intersecting points of each fiber, the nonwoven fabric is highly flexible. Specifically, if the oven temperature is set to 120° C., for example, the low-density polyethylene will melt and thermally bond the fibers together at the intersecting points of the fibers A, and the intersecting points of the fibers A and fibers B. Also, because there is a greater volume of low-density polyethylene fibers at the intersection of the fibers A than at the intersections of the fibers A and the fibers B, the strength of the intersecting points of the fibers A is greater than the strength of the intersecting points of the fibers A and the fibers B. Also, the high-density polyethylene of the fibers B does not melt, so the fibers do not become thermally bonded. In other words, the relationship of the strength of the intersecting points at this time is that the strength of the intersecting points of the fibers A is greater than the strength of the intersecting points of the fibers A and the fibers B, and the strength of the intersecting points of the fibers A and the fibers B is greater than the strength of the intersecting points of the fibers B.

Manufacturing Conditions

The blowing nozzles 913 shown in FIG. 9 have a diameter of 1.0 mm, and are formed in plurality at a pitch of 6.0 mm. Also, the shapes of the blowing nozzles 913 are substantially circles, and the cross-sectional shapes of the blowing nozzles 913 are cylindrical. The widths of the blowing nozzles 913 are 500 mm. These blow hot air with the conditions of temperatures at 105° C. and air capacity of 1200 l/minute.

With the fiber configuration described above, a fiber web is created by opening using a carding method at a speed of 20 m/minute and cutting the fiber web to widths of 450 mm. Also, the fiber web is conveyed onto a 20 mesh air-permeable net at a speed of 3 m/minute. Also, with the manufacturing conditions using the blowing unit 910 and blowing nozzles 913 described above and hot air blown onto the fiber web on the one hand, the hot air is being taken in (drawn in) from below the air-permeable net at an amount that is less than the blown hot air. Thereafter, with the fiber web being conveyed by the air-permeable net, it is conveyed inside the oven set to a temperature of 125° C. and hot blast air amount of 10 Hz, for approximately 30 seconds.

Results

Raised Ridge Portions: The basis weight is 51 g/m$^2$; the height of the thickness direction is 3.4 mm; the thickness of the peak is 2.3 mm; the fiber density is 0.03 g/cm$^3$; the width per one convex portion is 4.6 mm; and the pitches are 5.9 mm.

Note that the thickness of the peaks is the thickness of the nonwoven fabric itself at the peak portion of the convex portion. (This is the same below.)

Groove Portion: The basis weight is 24 g/m$^2$; the height of the thickness direction is 1.7 mm; the fiber density is 0.01 g/cm$^3$; the width per one groove is 1.2 mm; and the pitches are 5.8 mm.

Shape: The backside of the groove portions is the furthest backside which is the lowest bottom portion of the nonwoven fabric. The backside shape of the raised ridge portions rises up in the same direction as the raised ridge portions and is formed not to compose the furthest backside of the nonwoven fabric. Also, the shape of the raised ridge portions is formed to a substantial dome shape, and the raised ridge portions and groove portions are formed continuously to extend along a length direction. Also, the raised ridge portions and the groove portions are formed to mutually repeat in the width direction. Also, the furthest surface side of the convex portion is formed so that the strengths at the intersecting points of the fibers is partially different, and the fiber density is formed to be least compared to the fiber density of the nonwoven fabric formed in other embodiments described below.

3-2. Second Working Example

Fiber Configuration

The fiber configuration is the same as the first embodiment.

Manufacturing Conditions

The fiber web of the fiber configuration described above is placed on the air-permeable net, then conveyed inside the oven set to a temperature of 125° C., and a hot blast air amount of 10 Hz, for 30 seconds. Immediately after conveying from the oven (after approximately two seconds), hot air is blown with the conditions of a temperature of 120° C. and an air capacity of 2200 l/minute, with the design of the blowing unit 910 and blowing nozzles 913 described above.

Results

Raised Ridge Portions: The basis weight is 34 g/m$^2$; the height of the thickness direction is 2.8 mm; the thickness of the peak is 2.3 mm; the fiber density is 0.04 g/cm$^3$; the width per one convex portion is 4.0 mm; and the pitches are 6.1 mm.

Groove Portion: The basis weight is 21 g/m$^2$; the height of the thickness direction is 1.1 mm; the fiber density is 0.02 g/cm$^3$; the width per one groove is 2.1 mm; and the pitches are 6.1 mm.

Shapes: Raised ridge portions and groove portions are formed.

3-3. Third Working Example

Fiber Configuration

The fiber configuration is the same as the first embodiment.

Manufacturing Conditions

Using the blowing unit 910 and blowing nozzles 913 described above, while hot air is blown with the conditions of a temperature of 105° C., and hot blast air amount of 1000 l/minute, the hot air is being taken in (drawn in) from below the air-permeable net at an amount that is substantially the same, or slightly greater than the blown hot air.

Results

Raised Ridge Portions: The basis weight is 49 g/m$^2$; the height in the thickness direction is 3.5 mm; the fiber density is 0.02 g/cm$^3$; the width per one groove is 4.7 mm; and the pitches are 6.1 mm.

Groove Portion: The basis weight is 21 g/m$^2$; the height in the thickness direction is 1.8 mm; the fiber density is 0.01 g/cm$^3$; the width per one groove is 1.4 mm; and the pitches are 6.1 mm.

Shapes: Raised ridge portions and groove portions are formed, and the entire shape of the backside of the raised ridge portions is substantially flat to be the bottom surface.

3-4. Fourth Working Example

Fiber Configuration

The fiber configuration is the same as the first embodiment.

Manufacturing Conditions

An air current is blown with the conditions of a temperature of 80° C. and an air capacity of 1800 l/minute, with the design of the blowing unit 910 and blowing nozzles 913 described above. Also, while the fiber web of the fiber configuration described above is moved in the length direction at a speed of 3 m/minute, needles arranged in a staggered pattern at pitches of 5 mm in the length direction, and at 5 mm in the width direction partially-entangle the fibers by needle punches at a speed of 200 times/minute. Then, air is blow with the manufacturing conditions by the blowing unit 910 and the blowing unit 913 described above. Also, at the same time this in taken in (drawn in) at substantially the same amount or a slightly amount greater than the hot blast air amount, from below the air-permeable net.

Results

Raised Ridge Portions: The basis weight is 45 g/m$^2$; the height in the thickness direction is 2.3 mm; the fiber density is 0.02 g/cm$^3$; the width per one groove is 4.3 mm; and the pitches are 5.8 mm.

Groove Portion: The basis weight is 17 g/m$^2$; the height of the thickness direction is 0.8 mm; the fiber density is 0.02 g/cm$^3$; the width per one groove is 1.0 mm; and the pitches are 5.9 mm.

Shapes: The raised ridge portions and groove portions are formed continuously extending along the length direction. Also, the raised ridge portions and the groove portions which have partially entangled points facing downward, are formed to mutually repeat in the width direction.

3-5. Fifth Working Example

Fiber Configuration

Use a blend of a fiber A (average fineness: 3.3 dtex; average fiber length: 51 mm) coated with a hydrophilic oil solution, having a core-sheath structure of a high-density polyethylene and polyethylene terephthalate, and fiber B that differs from fiber A in that it is coated with a water-repellent oil solution. The mixing ratio of the fiber A and the fiber B is 70:30, and use a fiber aggregate adjusted to a basis weight of 40 g/m$^2$.

Manufacturing Conditions

The blowing nozzles 913 shown in FIG. 9 have a diameter of 1.0 mm, and are formed in plurality at a pitch of 6.0 mm. Also, the shapes of the blowing nozzles 913 are substantially circles, and the cross-sectional shapes of the blowing nozzles 913 are cylindrical. The widths of the blowing nozzles 913 are 500 mm. These blow hot air with the conditions of temperatures at 105° C. and air capacity of 1000 l/minute.

A stainless sleeve cut out in the shape of a lateral rectangle with rounded corners at a length of 2 mm and width of 70 mm is used for the supporting body. The pattern taken from the above with this sleeve is arranged in a lattice shape leaving open spaces of 3 mm in the machine direction, and 3 mm in the cross direction. Also, the thickness of the sleeve is 0.5 mm.

The fiber aggregate of the fiber configuration described above creates a fiber web by opening using a card apparatus at a speed of 20 m/minute and cutting the fiber web to widths of 450 mm. Also, the fiber web is conveyed with a 20 mesh air-permeable net at a speed of 3 m/minute. An air current is blown with the conditions of a temperature of 105° C. and an air capacity of 1200 l/minute, with the design of the blowing unit 910 and blowing nozzles 913 described above. Also, the air current is taken in (drawn in) at a smaller amount than the hot blast air amount, from below the air-permeable net. Thereafter, with the fiber web being conveyed by the air-permeable net, it is conveyed inside the oven set to a temperature of 125° C. and hot blast air amount of 10 Hz, for approximately 30 seconds.

Results

Raised Ridge Portions: The basis weight is 51 g/m$^2$; the height in the thickness direction is 3.4 mm; the thickness of the peak is 2.3 mm; the fiber density is 0.03 g/cm$^3$; the width per one convex portion is 4.6 mm; and the pitches are 6.7 mm.

Groove Portion: The basis weight is 9 g/m$^2$; the height in the thickness direction is 1.8 mm; the fiber density is 0.005 g/cm$^3$; the width per one groove is 2.1 mm; and the pitches are 6.7 mm.

Projection at Groove Portion: The basis weight is 18 g/m$^2$; the height of the thickness direction is 1.8 mm; the fiber density is 0.01 g/cm$^3$; the width per one projection is 2.1 mm; the length per one projection is 1.5 mm; the pitches in the machine direction are 5.0 mm; and the pitches cross direction are 6.7 mm.

Indentation at Groove Portion: The basis weight is 0 g/m$^2$; the height of the thickness direction is 0 mm; the fiber density is 0.0 g/cm$^3$; the width per one projection is 2.1 mm; the length per one projection is 3.5 mm; the pitches in the machine direction are 5.0 mm; and the pitches to cross direction that intersects a direction the groove portions extend are 6.7 mm.

Shapes: Each of the raised ridge portions, groove portions, projections and indentations are formed. The backside of the raised ridge portions uplifts in the same direction as the raised ridge portions, and is a shape not to form the furthermost backside of the nonwoven fabric. Also, with the groove portions, the projections and indentation are formed in plurality along a direction that the groove portions extend. The indentations are openings. The surface areas of the openings are rectangular-shaped in the longitudinal direction at 5.2 mm$^2$, and the corners are rounded.

3-6. Sixth Working Example

Fiber Configuration

The fiber configuration is the same as the fifth embodiment.

Manufacturing Conditions

The fiber configuration disclosed in the fifth working example is charged to the same sleeve, then conveyed inside the oven set to a temperature of 125° C., and a hot blast air amount of 10 Hz, for 30 seconds, while being conveyed by the air-permeable net. Immediately after conveying from the oven (after approximately two seconds), an air current is blown with the conditions of a temperature of 120° C. and an air capacity of 2000 l/minute, with the design of the blowing unit 910 and blowing nozzles 913 described above in relation to the fifth working example.

Results

Raised Ridge Portions: The basis weight is 34 g/m$^2$; the height in the thickness direction is 2.8 mm; the thickness of the peak is 2.3 mm; the fiber density is 0.04 g/cm$^3$; the width per one convex portion is 4.0 mm; and the pitches are 6.1 mm.

Groove Portion: The basis weight is 15 g/m$^2$; the height in the thickness direction is 1.9 mm; the fiber density is 0.008 g/cm$^3$; the width per one groove is 2.1 mm; and the pitches are 6.1 mm.

Projection at Groove Portion: The basis weight is 22 g/m$^2$; the height in the thickness direction is 1.9 mm; the fiber density is 0.01 g/cm$^3$; the width per one projection is 2.1 mm; the length per one projection is 1.5 mm; the pitches in the machine direction are 5.0 mm; and the pitches cross direction are 6.1 mm.

Indentation at Groove Portion: The basis weight is 9 g/m$^2$; the height of the thickness direction is 0.3 mm; the fiber density is 0.003 g/cm$^3$; the width per one projection is 2.1 mm; the length per one projection is 3.5 mm; the pitches in the machine direction are 5.0 mm; and the pitches cross direction are 6.1 mm.

Shapes: Each of the raised ridge portions, groove portions, projections and indentations are formed.

In this embodiment, a hot air blast is applied to the fiber web prior to the thermal fusion of the fibers being thermally bonded, so the hot air is blown when the degree of freedom of the fibers is low. In other words, because hot air is blown after the fibers are changed into nonwoven fabric, hot air is blown to maintain the framework formed by the thermal bonding of the fibers to a certain degree, to form the raised ridge portions and the groove portions. For that reason, it is possible to increase the maintainability of the concave and convex shapes under external pressure.

4. EXAMPLE APPLICATION

As an application of the nonwoven fabric of the present invention, the nonwoven fabric can be used as a surface sheet for an absorbent article, such as a sanitary napkin, a liner, and diapers, for example. In such cases, the raised ridge portions can either be the skin surface side, or the back surface side, but by applying the raised ridge portions to the skin surface side, the surface area in contact with the skin is reduced thereby making it difficult for the user to experience a moist sensation from body fluids. Also, the nonwoven fabric of the present invention can be used as the middle sheet arranged between the surface sheet and the absorbent body in the absorbent article. By using the nonwoven fabric of the present invention as the middle sheet, the surface area in contact with the absorbent body is reduced for the middle sheet and the surface sheet, and it is possible to reduce the return of liquids from the absorbent body to the surface sheet. Additionally, it is possible to use the nonwoven fabric of the present invention as side sheets of an absorbent article, the external surface (the external wrapping material) of diapers or the like, or female members such as hook-and-loop fastener. Using the nonwoven fabric of the present invention in these applications increases the feel of the product against the skin by lowering the surface area in contact with the skin, and improves cushioning. The nonwoven fabric can also be used in a wide range of applications such as wipers to remove dirt or grime adhering to a floor or a body, as a mask or as a breast-milk pad o r the like.

4-1. Surface Sheet of an Absorbent Article

As an application of the nonwoven fabric of the present invention, the convex and concave nonwoven fabric can be used as surface sheets 301 and 302 of an absorbent article, for example, as shown in FIGS. 16 and 17. In such cases, the nonwoven fabric is arranged so that the surfaces formed with the raised ridge portions are on the skin side.

When the nonwoven fabric is used as the surface sheets 301 and 302 of the absorbent article, and a predetermined liquid is excreted, that liquid mainly seeps into the groove portions. For example, even if the excreted liquid is viscous and contains solid particles, the liquid will fall into the groove portions, so it is possible to suppress the liquid from spreading widely over the surface. Also, the nonwoven fabric of the present invention are formed to be uneven by the groove portions 1 and the raised ridge portions, making it possible to lower the surface area that comes into contact with the skin, so the feeling against the skin is favorable. Also, even if the liquid once absorbed by the absorbent article returns back to the surface sheet, it is difficult for it to adhere widely to the skin.

Furthermore, because the majority of the fibers in the groove portions are oriented in the width direction, there is high tensile strength to the width direction, which prevents the surface sheets 301 and 302 from becoming damaged when force, such as friction, is applied at the width direction while the absorbent article is in use.

On the other hand, the sides of the raised ridge portions are formed by the fibers of the groove portions being moved when forming the groove portions, so the fibers are compacted together, thereby increasing their stiffness. Still further, the central portion of the raised ridge portions include many fibers oriented in the thickness direction, so this prevents them from being easily crushed when a load is applied to the raised ridge portions. Even if the raised ridge portions are crushed by a load, they have a high compression recoverability.

This makes it possible to maintain a low surface area in contact with the skin, even if the load applied to the surface sheet is changed by a change in body posture, and to maintain a favorable feeling against the skin. Still further, even if the liquid once absorbed by the absorbent article returns back to the surface sheet, it is difficult for it to adhere widely to the skin.

4-2. Middle Sheet of an Absorbent Article

As an application of the nonwoven fabric of the present invention, it is possible to use the nonwoven fabric as a middle sheet 311 of an absorbent article, for example, as shown in FIG. 18. In such cases, the nonwoven fabric is arranged so that the surface formed with the raised ridge portions are at the surface sheet 310 side.

Arranging the nonwoven fabric of the present invention as the middle sheet 311 so that the surface of the raised ridge portions is at the surface sheets 310 side, it is possible to establish a plurality of spaces between the surface sheets 310 and the middle sheet 311. For that reason, even when a large amount of fluid is excreted over a short amount of time, there are few inhibitory factors to liquid permeability, and it is possible to prevent the liquid from spreading widely at the surface sheets 310.

Also, even if the liquid that has once permeated the middle sheet 311 and is absorbed by the absorbent article returns back to the middle sheet 311, the contact ratio of the middle sheet 311 and the surface sheets 310 is low, so it is difficult for the liquid to return to the surface sheets 310 and adhering widely to the skin.

Also, the central portion of the raised ridge portions in the middle sheet 311 include many fibers that are oriented in the thickness direction compared to the sides and the groove portions, and because the peaks of the raised ridge portions and surface sheets 310 are adjacent, it is easy for the liquid remaining in the surface sheets 310 to be drawn in the thickness direction. This makes it difficult for the liquid to be retained at the surface sheets 310.

In this way, it is possible to attain spot-absorption and low-retention of the liquid with the surface sheets 310 and to prevent the liquid from adhering widely to the skin for long periods. Furthermore, because there is a high content percentage of fibers oriented toward the longitudinal direction at the side portion of the raised ridge portion in the middle sheet, it is possible to induce the liquid to travel from the surface sheets 310 to the middle sheet 311 side portion in the longitudinal direction. This prevents leaking from the absorbent article, even if the liquid spreads to the width direction, and increases the absorbing efficiency of the absorbent body.

4-3. External Wrapping Material of an Absorbent Article

As an application of the nonwoven fabric of the present invention, it is possible to use the nonwoven fabric as an external surface (external wrapping material 321) of an absorbent article, for example, as shown in FIG. 19. In such cases, the nonwoven fabric is arranged so that the surfaces formed with the raised ridge portions are on outer side of the absorbent article.

By arranging the raised ridge portions in this way, the feeling against the skin is favorable when the absorbent article using the nonwoven fabric of the present invention as the external wrapping material 321 is touched by hand. Also, because the basis weight and the fiber density of the groove portions is less, it has superior air permeability.

5. COMPONENTS

The following will now explain the components in detail.

5-1. Nonwoven Fabric

5-1-1. Fiber Aggregate

The fiber aggregate is formed by substantial sheet shapes. The fibers that compose the fiber aggregate have a degree of freedom. Said another way, the fiber aggregate has a degree of freedom between the fibers. Here, the degree of freedom between the fibers means that the fiber web of the fiber aggregate can be moved freely by the fluid. This fiber aggregate can be formed by blowing to form fibrous layers of a predetermined thickness of fibers blended of a plurality of fiber types. For example, it is possible to blow each of a plurality of different fibers to form a fiber layer that is laminated a plurality of times.

A fiber web formed by the carding method, or a fiber web prior to the solidifying of thermal bonded fibers are examples of the fiber aggregate of the present invention. Webs formed by an air laid methodmethod, or a fiber web prior to the solidifying of thermal bonded fibers are also examples. Another example is a fiber web prior to the solidifying of thermal bonded fibers embossed by a point bonding methodmethod. Yet another example can be an embossed fiber aggregate prior to fiber forming by a spunbonding methodmethod, or an embossed fiber aggregate prior to the solidifying of thermal bonded fibers. A fiber web partially entangled, formed by a needlefelt method is yet another example. Still further, is the example of fiber web partially entangled, formed by the spun lacing methodmethod. A fiber aggregate can also be formed by a meltblown methodmethod prior to the solidifying of thermal bonded fibers. Or there is the fiber aggregate formed by a solvent bonding method prior to the solidifying of thermal bonded fibers.

Also, preferably, a fiber web that is formed by the carding method that uses a comparatively long fiber that can easily be reoriented by an air (or a gas) current is used. Also, a web prior to being formed by entangling, with a high degree of freedom between fibers prior to thermal bonding is another example. Also, the air-through method is preferred to thermally bond thermoplastic fibers in the fiber aggregate using an oven (thermal treatment) at a predetermined heating device to create nonwoven fabric that hold their shape after forming the groove portions (concave and convex portions) using a plurality of air (gas) currents.

5-1-2. Fibers

Some examples of suitable thermoplastics that can be utilized include a low-density polyethylene, a high-density polyethylene, a straight-chain polyethylene, polypropylene, polyethylene terephthalate, denatured polypropylene, denatured polyethylene terephthalate, nylon, polyamides and the like, and resins individually or in compounds.

The core-sheath type core component's melting point is higher than the sheath components, an eccentric type of core-sheath, and a side-by-side type whose left and right components have different melting points are examples of the shapes of the compounds. It is acceptable to mix hollow types, odd-shaped types, such as flat, Y-shaped or C-shaped types, 3D crimped fibers, such as actually crimped fibers and latent crimped fibers, or split fibers that split under physical loads such as streams, heat or embossing.

Also, to form a 3D crimped shape, it is possible to blend predetermined actually crimped fibers and latent crimped fibers. Here, a 3D crimped shape includes a spiral shape, a zigzag shape, and an Ω shape. The fiber orientation partially faces the thickness direction, even if they primarily face a plane direction. Because of this, the buckling strength of the fibers themselves works in the thickness direction so it is difficult for the volume to be crushed by external pressure. Still further, if the spiral shape is used, the fibers return to their original shape when the external pressure is released, so even if the bulk is slightly crushed by excessive external pressure, it is easier for it to return to its original shape after the external pressure is released.

Actually crimped fiber is a generic term for fibers that are crimped in advance by applying a shape using mechanical crimping, and a core sheath structure that is an eccentric type, or by side-by-side, or the like. Crimping is produced in latent crimped fiber when heat is applied.

Mechanical crimping means to apply a crimped shape to a straight-shaped fiber consecutively after forming the fiber by applying different circumference speeds to the line speed, and heat and pressure. The degree of crimping can be controlled by the circumference speed difference of the line speed, the heat and pressure. Crimped fibers can increase the buckling strength under external pressure as the number of crimps per unit length is increased. For example, the number of crimps can be in a range between 10 to 35 per inch; preferably between 15 to 30 crimps per inch.

Latent crimped fiber is fiber composed of two or more resins having different melting points. Because their heat contraction ratios are different because of their different melting points when heat is applied, these fibers are crimped in 3D. The resins composing the cross-section of the fibers can include an eccentric type of core-sheath structure, or a side-by-side type whose left and right components have different melting points. The heat contraction ratios of these kinds of fibers can be in the range from 5 to 90%, or preferably from 10 to 80%.

To measure heat contraction ratios, (1) create a web of 200 $gm/m^2$ using 100% of the fiber to be measured; (2) create a sample by cutting the fiber into 250×250 mm sizes; (3) leave the sample inside an oven set to 145° C. (418.15 K) for five minutes; (4) measure the length dimensions of the fiber after shrinkage; (5) then calculate from the difference of the length dimension of before and after shrinkage.

If the nonwoven fabric of the present invention is used as a surface sheet, the fiber size is preferred to be in the range between 1.1 to 8.8 dtex, when considering suction of liquids and the feeling against the skin, for example.

If the nonwoven fabric of the present invention is used as a surface sheet, it is acceptable to include hydrophilic fibers such as pulp, chemical pulp, rayon, acetate, or cellulose such as natural cotton to absorb small amounts of menstrual blood or sweat that can remain on the skin, as the fibers to compose the fiber aggregate. However, because cellulose-based fibers do not easily discharge a liquid once it has been absorbed, it is preferable that they are blended to the overall fiber content in a range of from 0.1 to 5% by weight.

If the nonwoven fabric of the present invention is used as a surface sheet, it is acceptable to mix or to coat with a hydrophilizing agent or a water repellent to the hydrophobic synthetic fabric described above, in consideration of ability to take in liquids and back-flow of the liquid. It is also acceptable to hydrophilize using corona treatment or plasma treatment. It is also acceptable to include water repellent fibers. The water repellent fibers can be those treated with known water repellents.

To increase the whiteness, it is also acceptable to include an inorganic filler such as titanium oxide, barium sulfate, and calcium carbonate. If these inorganic fillers are component fibers of a core-sheath type, it is acceptable to include only in the core, or only in the sheath.

Also, as described above, a fiber web formed by the carding method that uses comparatively long fibers is easy to reorient the fibers using an air current. After forming groove portions (creating concave/convex portions) using a plurality of air currents, it is preferable to use the air-through method that thermally bonds thermoplastic fibers by oven treatment (heat treatment) to create nonwoven fabric that maintain their shape. As fibers that are appropriate for this manufacturing method, it is preferable to use fibers of a core-sheath structure or a side-by-side structure to thermally bond to melt the intersecting points of the fibers, and it is preferable that they are composed by fibers of a core-sheath structure which is easy to thermally fuse the sheaths together securely. Particularly, it is preferable to use core-sheath synthetic fibers composed of polyethylene terephthalate and polyethylene, or composed of polypropylene and polyethylene. It is possible to use each of these individually or in combinations of two or more types for these fibers. Also, fiber lengths are 20 to 100 mm, and particularly preferably from 35 to 65 mm.

5-2. Nonwoven Fabric Manufacturing Apparatus

5-2-1. Fluid Composed Mainly of a Gas

The fluid, composed mainly of a gas, in the present invention is a gas adjusted to room temperature or to a predetermined temperature, or is an aerosol containing solids in the gas or fine particles of a liquid.

Air or nitrogen are examples of the type of gas that can be used. Also, air can include vapor of a liquid, such as moisture vapor.

Liquids or solids can be dispersed in the gas of the aerosol. The following are examples. These include ink for coloring; a softener such as silicon to increase softness; an activator such as a hydrophilizer or water repellent as antistatic finish or to control wetness; an inorganic filler such as titanium oxide and barium sulfate to increase the energy of the fluid; a powder bond such as polyethylene to increase the energy of the fluid and to increase the ability to maintain the concave and convex forms under heat treatment, an antihistamine agent such as diphenhydramine hydrochloride and Isopropyl methyl phenol to prevent itchiness, a humectant, and sterilizing agent. The solids can also include gel forms.

The temperature of the fluid, composed mainly of a gas, can be adjusted as is appropriate. It is possible to adjust this for the nature of the fiber that composes the fiber aggregate, and the shape of the nonwoven fabric to be manufactured.

Here, to properly move the fibers that compose the fiber aggregate using the blown fluid, it is preferable that the temperature of the fluid be at a high temperature to a certain degree. This is because if the temperature of the fluid is high, the freedoms of the fibers that compose the fiber aggregate increases. Also, if thermoplastic fibers are included in the fiber aggregate, it is possible to soften or melt the thermoplastic fibers arranged at areas blown by the fluid, composed mainly of a gas, by setting the temperature of the fluid, composed mainly of a gas, to one that can soften the thermoplastic fibers, and then to re-solidify them.

Through this, the shapes of the nonwoven fabric blown by the fluid, composed mainly of a gas, are maintained. Also, this provides adequate strength so that the fiber aggregate (nonwoven fabric) do not fall apart when the fiber aggregate is moved by the moving means.

The flow amount of the fluid, composed mainly of a gas, can be adjusted as is appropriate. Concrete example of the fiber aggregate of fibers having a degree of freedom, include a fiber web 100 composed of a high-density polyethylene in a sheath, and polyethylene terephthalate in a core; a fiber length of 20 to 100 mm, preferably 35 to 65 mm; fiber size of 1.1 to 8.8 dtex, preferably 2.2 to 5.6 dtex core-sheath fibers; a fiber length of 20 to 100 mm, preferably 35 to 65 mm if opened by the carding method; a fiber length of 1 to 50 mm, preferably 3 to 20 mm if opened by the airlaying method; and adjusted to 10 to 1000 $g/m^2$, preferably 15 to 100 $g/m^2$. Conditions for the fluid, composed mainly of a gas, in the blowing unit 910 formed with a plurality of blowing nozzles 913 shown in FIGS. 8 and 9 (blowing nozzles 913: diameter: 0.1 to 30 mm; preferably 0.3 to 10 mm; pitch: 0.5 to 20 mm, preferably 3 to 10 mm; shape: a substantially circle or a substantially elliptical circle), to blow the fiber web 100 include the temperature of the hot air between 15 to 300° C. (288.15 K to 573.15 K); preferably 100 to 200° C. (373.15 K to 473.15 K); and an air capacity of 3 to 50 (L/(min·hole), preferably 5 to 20 (L/(min·hole). For example, when the fluid, composed mainly of a gas, is blown under the conditions outlined above, a fiber aggregate that allows the composing fibers to change their positions and orientation is a favorable one of the present invention. This kind of fiber can be formed into the nonwoven fabric shown in FIGS. 2A to 3 by creating it under the manufacturing conditions. It is possible to attain the dimensions and basis weight of the groove portions 1 and the raised ridge portions 2 with the following ranges. For the groove portions 1, the thickness is 0.05 to 10 mm; preferably at a range between 0.1 to 5 mm; the width is between 0.1 to 30 mm; preferably at a range between 0.5 to 5 mm; and the basis weight is between 2 to 900 g/m$^2$; preferably at a range of 10 to 90 g/m$^2$. For the raised ridge portions 2, the thickness is between 0.1 to 15 mm; preferably at a range between 0.5 to 10 mm; the width is 0.5 to 30 mm; preferably at a range between 1.0 to 10 mm; and the basis weight is between 5 to 1000 g/m$^2$; preferably at a range between 10 to 100 g/m$^2$. It is possible to create the nonwoven fabric at the range of the above numerical values, but these ranges are not intended to limitations.

5-2-2. Air-permeable Support Member

As an air-permeable support member, a support member whose side that supports the fiber web 100 is substantially a plane or substantially curved, or whose surface of the substantially a planar state or substantially curved state is substantially flat. As a substantially planar state or substantially curved state, a plate or a cylinder can be used. Also, a substantially flat state means that the surface of the fiber web 100 on the support member does not form irregularities. Specifically, it is possible to use a support member whose mesh does not form concave or convex shapes in the mesh supporting member 210.

As an air-permeable support member 200, a plate-shaped support member or a cylindrically shaped support member can be used. Specifically, the mesh supporting member 210 and the supporting member 270 described above are examples.

Here the air-permeable support member 200 can be detachably arranged at the nonwoven fabric manufacturing apparatus 90. This appropriately disposes the air-permeable support member 200 according to the desired nonwoven fabric. Said a different way, the air-permeable support member 200 can be replaced by another air-permeable support member selected from a plurality of different air-permeable support members at the nonwoven fabric manufacturing apparatus 90.

The mesh-shaped portion at the mesh supporting member 210 shown in FIGS. 4A and 4B or the mesh supporting member 270 shown in FIG. 15 will be now be described below. As a air-permeable mesh portion, examples of a woven air-permeable net include threads made from resins such as polyester, polyphenylene sulfide, nylon, and conductive monofilaments, or metallic threads such as stainless steel, copper and aluminum, or air-permeable nets woven from plain fabric, twills, satin, double cloths, and spirals.

It is possible to partially vary degree of air-permeability of the net by partially varying weaving method, thickness of the thread, and the thread shapes. Specifically, examples include an air-permeable mesh of a spiral weave using polyester, or an air-permeable mesh of a spiral weave using a flat-shaped and round-shaped thread of stainless steel.

As a plate-shaped support member, a sleeve created use a metal such as stainless steel, copper, or aluminum can be used. The sleeve can be partially cut-out of a metal plate using a predetermined pattern. The cut-out portion of the metal becomes the ventilation portion, and the portions not cut-out from the metal are not air-permeable. Also, in the same way as was described above, it is preferable that the surface of the portion that is not air-permeable be smooth to increase the ability of the surface to slide when in contact with an object.

Examples of a sleeve include a stainless steel sleeve with 3 mm-long, 40 mm-wide rounded-corner, laterally oblong shape. The sleeve can have holes cut-out of metal disposed at 2 mm pitches in the line flow direction (moving direction), and at pitches of 3 mm in the width direction. The sleeve thickness is 0.3 mm.

The sleeve is disposed with holes arranged in a zigzag form. For example, a stainless steel sleeve can have 4 mm-diameter, round holes cut-out of metal disposed at 12 mm pitches in the line flow direction (moving direction), and in a zigzag shape at pitches of 6 mm in the width direction. The sleeve thickness is 0.3 mm. In this way, the cut-out pattern (the formed holes) and arrangement can be set at a suitable time.

Also, an example can be the mesh supporting member 260 shown in FIG. 11 equipped with predetermined projections. For example, this can be an air-permeable support member where the locations not directly blown by the fluid have projections (for example wave-shapes) alternating in the line flow direction (movement direction). By using a mesh supporting member 260 with this kind of shape, it is possible for predetermined openings to be formed, and to attain nonwoven fabric formed overall with the alternating projections (for example wave-shapes) shapes at the mesh supporting member 260.

5-2-3. Blowing Means

The blowing unit 910 as the blowing means varies the direction of the fluid, composed mainly of a gas, so it is appropriately adjusting spacing of the concave portions (groove portions) in the formed concave and convex portions, and the heights of the raised ridge portions. For example, by configuring this to be able automatically change the direction of the fluid, it is capable of adjusting to enable the grooves to be vermiculated (waves or zigzag-shaped) or other shapes. Also, by adjusting the blowing amount and blowing times of the fluid, composed mainly of a gas, it is possible to appropriately adjust the shapes of the grooves and openings and the shape patterns. It is acceptable for the angle for blowing the fluid, composed mainly of a gas, on to the fiber web 100 to be vertical, or facing a predetermined angle toward the line flow direction which is the movement direction F at the moving direction F of the fiber web 100, or to be a predetermined angle opposite the line flow direction.

5-2-4. Heating Means

As methods for bonding the fibers 101 in the nonwoven fabric 170 formed with the predetermined openings, a needle-punch method, a spunlace method, bonding using a solvent bonding method, or thermal fusion bonding using a point-bonding method or air-through method, but the air-through method is preferred for maintaining the predetermined shapes of the formed openings. Also, heat treatment is preferred with the air-through method using the heater 950 as the heating means.

5-2-5. Others

The nonwoven fabric manufactured by being heated by the heater 950 are moved to a process for cutting the nonwoven fabric at predetermined shapes, and a process for retrieval by a conveyor 930 and a conveyor 940 that continues in the predetermined direction F. The conveyor 940 can be equipped with a belt 949, and rotors 941, in the same way as the conveyor 930.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A nonwoven fabric of overlapping fibers bonded in a three-dimensional structure, said non-woven fabric comprising on a first surface thereof:

a plurality of groove portions longitudinally extending in a first direction; and a plurality of raised ridge portions longitudinally extending in the first direction, said groove portions and raised ridge portions being alternately arranged adjacent to each other in a second direction transverse to the first direction;

wherein said fabric comprises first oriented fibers oriented in the first direction; and second oriented fibers oriented in the second direction;

each of the raised ridge portions has side portions opposite one another in the second direction, and a central portion between said side portions;

the central portion has a height between 0.3 mm and 15 mm in a thickness direction of the fabric, and said height of the central portion is greater than that of said side portions;

the side portions include the first oriented fibers which have been moved from adjacent groove portions to said side portions by a fluid directly blown upon the groove portions during manufacture of the fabric, and the side portions have a content percentage of the first oriented fibers greater than that of the central portion;

a content percentage of the second oriented fibers in the groove portions is greater than those in the side portions and in the central portions;

a content percentage of the first oriented fibers in the groove portions is lower than that in the central portions;

a fiber density at a bottom portion of each of the groove portions is between 0.002 to 0.18 g/cm$^3$;

a fiber density in each of the central portions of the raised ridge portions is between 0.005 to 0.20 g/cm$^3$; and a fiber density in each of the side portions of the raised ridge portions is between 0.007 to 0.25 g/cm$^3$.

2. The nonwoven fabric according to claim 1, wherein the content percentage of the first oriented fibers in the central portions is at least 10% lower than that in the side portions and at least 10% higher than that in the groove portions.

3. The nonwoven fabric according to claim 2, wherein the content percentage of the first oriented fibers in the central portions is in a range between 40-80%;

the content percentage of the first oriented fibers in the side portions is in a range between 55 to 100%; and the content percentage of the second oriented fibers in the groove portions is in a range between 55 to 100%.

4. The nonwoven fabric according to claim 1, wherein in each of the side portions, the content percentage of the first oriented fibers is greater than that of the second oriented fibers;

in each of the groove portions, the content percentage of the second oriented fibers oriented in the second direction that is perpendicular to the first direction is greater than that of the first oriented fibers oriented in the first direction;

in each of the central portions, the content percentage of the first oriented fibers is greater than that of the second oriented fibers.

5. The nonwoven fabric according to claim 4, wherein an average basis weight of entire said nonwoven fabric including the groove portions and the raised ridge portions is between 20 to 100 g/m$^2$;

a basis weight of the bottom portion of each of the groove portions is lower than the average basis weight of the entire nonwoven fabric, and is between 5 to 80 g/m$^2$; and an average basis weight of each of the raised ridge portions is greater than the basis weight of the bottom portion of each of the groove portions, wherein the basis weight of each of the central portions is between 15 to 250 g/m$^2$, and the basis weight of each of the side portions is between 20 to 280 g/m$^2$.

* * * * *